US005129640A

United States Patent [19]

Kosaka et al.

[11] Patent Number: 5,129,640

[45] Date of Patent: * Jul. 14, 1992

[54] SHEET FINISHER

[75] Inventors: Kenji Kosaka, Naka; Hiroshi Kimura, Manabeshin; Akihiro Suzuki, Ibaraki; Kenji Hayashi, Takaba, all of Japan

[73] Assignee: Ikegami Tsushinki Co., Ltd., Tokyo, Japan

[ * ] Notice: The portion of the term of this patent subsequent to Jun. 4, 2008 has been disclaimed.

[21] Appl. No.: 709,295

[22] Filed: Jun. 3, 1991

Related U.S. Application Data

[63] Continuation of Ser. No. 378,051, Jul. 11, 1989, Pat. No. 5,020,785.

[30] Foreign Application Priority Data

| | | | |
|---|---|---|---|
| Jul. 14, 1988 | [JP] | Japan | 63-173884 |
| Jul. 14, 1988 | [JP] | Japan | 63-173885 |
| Jul. 14, 1988 | [JP] | Japan | 63-173886 |
| Jul. 14, 1988 | [JP] | Japan | 63-173887 |
| Jul. 14, 1988 | [JP] | Japan | 63-173888 |
| Jul. 14, 1988 | [JP] | Japan | 63-173889 |
| Jul. 14, 1988 | [JP] | Japan | 63-173890 |

[51] Int. Cl.[5] ..... B42B 2/00

[52] U.S. Cl. ..... 270/53; 270/58

[58] Field of Search ..... 270/37, 53, 58, 45; 271/3.1

[56] References Cited

U.S. PATENT DOCUMENTS

| | | | |
|---|---|---|---|
| 4,382,592 | 5/1983 | Harding | 270/53 |
| 4,640,611 | 1/1987 | Ohdake et al. . | |
| 4,717,134 | 1/1988 | Iida et al. . | |
| 4,762,312 | 8/1988 | Ushirogata | 270/53 |
| 4,917,366 | 4/1990 | Murakami | 270/37 |
| 5,020,785 | 6/1991 | Kosaka | 270/53 |

FOREIGN PATENT DOCUMENTS

| | | | |
|---|---|---|---|
| 0033835 | 8/1981 | European Pat. Off. . | |
| 0113122 | 7/1984 | European Pat. Off. . | |
| 0266739 | 5/1988 | European Pat. Off. . | |
| 69346 | 4/1984 | Japan . | |
| 60-15357 | 1/1985 | Japan . | |
| 60-122662 | 7/1985 | Japan . | |
| 60-232372 | 11/1985 | Japan | 270/45 |
| 211272 | 9/1986 | Japan . | |
| 217476 | 9/1986 | Japan . | |
| 62-119069 | 5/1987 | Japan | 270/53 |
| 62-244869 | 10/1987 | Japan . | |
| 62-269852 | 11/1987 | Japan | 270/53 |
| 63-41350 | 2/1988 | Japan . | |
| 61183055 | 10/1988 | Japan . | |

OTHER PUBLICATIONS

Japanese Patent Abstract, JP-A-61 183055, Fuji Xerox Co., Ltd., Aug. 15, 1986.

Japanese Patent Abstract, JP-A-60 015 357, Fuji Xerox K.K., Jan. 26, 1985.

*Primary Examiner*—Edward K. Look

*Assistant Examiner*—Therese M. Newholm

*Attorney, Agent, or Firm*—Oliff & Berridge

[57] ABSTRACT

The sheet finisher includes a predetermined folding mode for receiving a sheet from a copy machine and which features a plurality of transfer guides through which the sheets received from the copy machine are selectively transferred; switching flappers for switching the flow of the sheet between guides, a temporary holding guide in which the leading end portion of sheets can be temporarily inserted; a sheet folding arrangement including press roller pairs for folding the sheets; a sheet discharge angle control device which varies the angle at which the sheets are discharged onto an upper tray in accordance with the folding mode that is being used; a tray shift mechanism for moving the tray left and right so as to stack the sheets which are discharged thereonto in a classifying manner; a friction roller for moving a predetermined corner of each of the sheets into a preselected corner of the tray; a fastening device for fastening the sheets which have been maneuvered into the preselected corner by the friction roller; a tray rise mechanism for changing the distance between the upper surface of the tray and the level at which the sheets are discharged; an escape mechanism which drops processed stacks of sheets from the upper tray into a lower one; and a tray angle varying mechanism for changing the angle of the lower tray when the stacks are dropped theretowards.

4 Claims, 17 Drawing Sheets

SHEET FINISHER

This is a continuation of application Ser. No. 07/378,051 filed Jul. 11, 1989, now U.S. Pat. No. 5,020,785.

BACKGROUND OF THE INVENTION

1. Field of the Invention

The present invention relates to a sheet finisher which can appropriately fold, sort, fasten and collect sheets which have come out of a copy machine and the like.

2. Description of the Prior Art

Japanese Patent Application Laid-Open No. 61-211272 (1986) discloses a previously proposed sheet finishing device.

This device is arranged to take the sheets which have come out of a copy machine, fold the same and then eject them onto an upper tray. Following this, the sheets on the upper tray are induced to engage a stopper and become aligned. They are then fastened together by stapling. After this fastening operation, the stopper is rotated and the fastened stack of sheets is collected by being dropped onto a lower tray. In this device the lower tray is arranged at a predetermined inclined or slanted angle.

However, with this prior art arrangement, as the stacks of sheets which are fastened together are induced to drop onto the lower tray under the influence of the stopper rotation only, the assuredness with which the sheets are unfailingly dropped into the intended position is low. That is to say, if the upper tray is formed of normal types of plastic, the effect of friction and static electrical charges hinders the sliding of the sheets.

In order to overcome the effect of the friction and static electricity, if the angle of the upper tray is overly increased, the capacity of the tray is undesirably reduced.

Further, if lower tray angle is fixed the capacity of the same is limited.

In particular, if a Z folding mode is selected, the folds of the Z folded sheet cause the thickness of the stack to become three times greater than normal. Depending on the number of stacks accumulated on the lower tray, the entry angle which is defined by a vertical line and the lower tray, rapidly becomes reduced.

Under these conditions, in the worst case, as the stack of sheets is dropped, the leading edge of the stack strikes against those already received in the tray and results in spillage.

Normally, with the so called Z sheet folding function, the sheets which are required to be folded in the folding device, are half folded and the half folded sheets are then again folded in half.

A prior art device which features this Z folding function is disclosed in Japanese Patent Application Laid-Open No. 61-217476 (1986).

In this arrangement a sheet folding transfer chute and a sheet transit chute having a pair of discharge rollers are provided at the downstream of an entrance deflector which is switched in accordance with the presence or absence of the demand for folding.

A first deflector is interposed at the downstream end of this sheet folding transfer chute, and first and second folding rollers which constitute a pair of folding rollers of a first folding stage and a folding position control guide chute are also provided.

Further, a second deflector is interposed downstream of the folding rollers of the first folding stage and second and third folding rollers which constitute a second folding stage roller pair and a second folding position control guide chute are provided.

Additionally, a third deflector is interposed downstream of the second folding stage roller pair, and third and fourth folding rollers which constitute a third folding stage roller pair and a third folding position control guide chute are provided.

Downstream of the roller pair of the third folding stage, a final guide chute is provided which merges with the above mentioned transit chute at its end.

A discharge roller is provided at the downstream of the final guide chute and the transit chute and arranged to discharge the treated sheets through an ejection opening onto a tray.

However, with this type of folding device when forming the folds in the sheets, as the sheet folding position control guide chute which receives the leading end of the sheet subjects the sheet to a degree of resistance, the bowing of the central portion of the sheet which is pinched by the folding rollers is reduced, and in addition to this during the half and Z folding modes, for example, depending on the size of the sheet, first to third sets of folding rollers are necessary in addition to the sheet folding position control guide chute. Accordingly, the construction of the finisher becomes complex, expensive and cannot be rendered compact.

Further, as the discharge rollers and the tray are fixed in place, it is not possible for example, to continuously Z fold a large number of sheets. That is to say, as the thickness of the folded and unfolded ends of the Z folded sheets is notably different, as the number of sheets increases the upper surface of the stacked sheets rapidly becomes inclinded with respect to the surface of the tray.

Under these conditions the accumulative capacity of the device is lowered and the manner in which the sheets are discharged and pushed out onto the tray deteriorates the stacking neatness.

Further, the sheet folding mechanism is required to include a half folding mode which folds the sheets in half, a Z folding mode which folds the sheets and then folds the folded section again, in addition to a non-folding mode.

With this above mentioned prior art arrangement irrespective of the sheet folding mode the sheets which have been processed are discharged at a predetermined height above the tray. As the thickness of the folded sheets is two to three times that of the non-folded ones, in order to increase the accumulative capacity, it has been proposed to increase the distance between the top of the tray and the sheet discharge means.

However, this measure leads to the problem that, particularly during the non folding mode, the mass per unit area of the sheet is relatively small and the neatness with which the sheets are stacked is reduced. That is to say, the layer of air between the sheet being discharged and the surface onto which the sheet is intended to drop, produces a floating effect which deteriorates the neatness with which the sheets pile one on the other.

Normally, sheet finishers are provided with a fastening device which staples the collected stack of sheets together. While this appears to be desirable at first glance, before the sheets can be appropriately stapled they must have their side and top edges aligned.

In order to achieve this alignment or setting, one prior proposed arrangement has provided the tray with two side edges and base section and has utilizes the weight of the sheet in combination therewith to define means for suitably aligning the sheets in a suitably neat manner.

An alternative arrangement has provided one fixed side edge, a base and has added an adjustable guide which pushed sideways toward the single fixed edge in order to improve the neatness of the sheet stack.

However, the former arrangement is such that as the width of the guide is fixed, and cannot be reduced to exactly that of the sheets in order to permit the same to received without incident, the desired effect has not been achieved. With the latter arrangement in order to adjust the width of the guide, a drive mechanism is necessary. This provision increases the bulk of the arrangement undesirably and further does not permit the mixing of different sheet sizes.

In connection with the fastening devices which staple the stack of sheets together, the stapler must be moved to a fastening position for the stapling operation and then back to its home or original position after the stapling is completed. An example of a mechanism for returning the stapler to its original or home position can be found in Japanese Patent Application Laid-Open No. 59-69346 (1984).

However, with this type of prior art arrangement the stapler must be moved a relatively large distance from its home position to its fastening one. As a result the layout of the finisher is rendered undesirably wide and prevents the achievement of a desirably compact arrangement.

A further problem comes in that the large distance through which the stapler must be moved requires a finite amount of time and slows the overall operation of the finisher.

It is an object of the present invention to provide a sheet finisher which overcomes the above mentioned prior art drawbacks and which features a compact construction.

It is another object of the present invention to provide a sheet finisher which includes a sheet folding device which has a simple and compact construction of transfer chutes and which is inexpensive to manufacture.

It is a further object of the present invention to provide a sheet finisher which includes a folded sheet discharging mechanism which increases the sheet accumulation capacity thereof without loss of sheet alignment capabilities.

It is still another object of the present invention to provide a sheet finisher which features a simple and compact construction and which simultaneously maintains highly acceptable alignment and accumulation characteristics.

It is a still further object of the present invention to provide a compact sheet finisher which is able to accurately compile sheets irrespective of their size.

It is another object of the present invention to provide a sheet finisher which features a compact construction and which accommodates the accumulation of a large amount of sheets without loss of alignment characteristics.

It is a further object of the present invention to provide a sheet finisher which includes an accommodation or storage arrangement which can assuredly unload stacks of sheets from the upper tray onto a lower one.

It is another object of the present invention to provide a sheet finisher which features a compact construction together with fastening arrangement which reduces the amount of time required for stapling the stacks of sheets together.

In order to achieve the above objects a first aspect of the invention features the provision of: first and second transfer guides, the first guide being arranged to receive sheet which is introduced in the finisher; a first a sheet direction switching means for selectively guiding the sheet into one of the first and second transfer guides; a temporary accommodation guide arranged to receive the leading ends of the sheet which is transferred through the first transfer guide; a third transfer guide arranged to extend from the outlet of the first guide to the outlet of the second guide; a first pair of press rollers disposed at the entrance of the third transfer guide and arranged to press a fold into the sheet which passes therebetween; first restricting means disposed in temporary accommodation guide for restricting the movement of the leading edge of the sheet; a second pair of press rollers disposed adjacent to the exits of the second and third transfer guides, the second pair of press rollers being arranged to press a fold into the sheet which passes therebetween; a second sheet direction switching means for selectively guiding the sheet which is transferred through the third transfer guide into one of the second transfer guide and the second pair of press rollers, the second sheet direction switching means being disposed at the exit of the third transfer guide; second restricting means disposed in the second transfer guide for restricting the movement of the leading edge of the sheet; a first pair of transfer rollers disposed in the first transfer guide; and a second pair of transfer rollers disposed in the third transfer guide.

In accordance with the first aspect of the invention, during the half folding mode the sheet which is transferred through the first transfer guide is introduced into the temporary accommodation guide to the degree wherein the mid portion of the sheet is induced to bow toward and be pressed by a first pair of press rollers in a manner to form a fold across the middle of the sheet. This half folded sheet is then transferred by way of the third transfer guide to the second pair of press rollers whereafter it is discharged.

On the other hand, during the Z folding mode, the movement of the leading edge of the sheet which is transferred from the first guide arrangement to the accommodation guide is restricted by the first restricting means at a ¼ way position. Then, the ¼ length portion thereof is induced to bow toward and sandwiched between the first pair of press rollers to form a crease.

Following this, the sheet is transferred through the third transfer guide and selectively guided in a manner which causes it to slide in the reverse direction into the second transfer guide. The second restricting means limits the entry into the second transfer guide to the degree that the mid portion of the sheet is induced to bow toward and be pressed between the second pair of press rollers. This produces a second fold in the middle of the sheet and the thus Z folded sheet is then discharged.

Further, in the case that sheet folding is not required the first switching means is set to guide the sheets into the second guide arrangement wherein they are passed through the second press roller pair and then discharged.

Therefore in accordance with the present invention, as the second guide arrangement functions as a guide for non-folded sheets and also acts as a temporary accommodation guide, it is possible to render the guide arrangement both simple and compact.

A second aspect of the present invention comprises means for producing a plurality of sheet folding modes including a Z folding mode; a pair of discharge rollers arranged to, discharge a sheet onto a tray; and sheet discharge angle control means for varying the angle at which the sheet is discharged by the pair of discharge rollers in accordance with a predetermined folding mode.

In accordance with the second aspect of the present invention, during the above mentioned predetermined folding mode, the angle at which sheet is discharged onto the tray is varied in a manner wherein, during the Z folding mode by way of example, if the angle at which the sheet is discharged is large even under the conditions wherein a plurality of sheets accumulate, the discharged sheet does not collide with the collected stack and the alignment and the stacking characteristics are simultaneously improved.

A third aspect of the present invention features a plurality of folding modes wherein the folding device includes a discharge roller pair which ejects sheets onto a tray, and which is constructed such that, in accordance with a predetermined folding mode, one portion of the lower surface or floor of the tray on which the discharged sheets are collected can be raised and lowered by a drive means so that the distance between the floor and the discharge rollers can be varied.

In accordance with the third aspect of the present invention, during the above mentioned sheet folding mode the raising and lowering of the floor portion changes the distance between the tray floor and the discharge device such that, during the non-folded sheet mode for example, the above mentioned portion of the floor is raised in a manner wherein the tendency for the sheet to float on the layer of air between the discharged sheet and those on top of the tray, is reduced in a manner which improves the alignment characteristics of the arrangement. On the other hand, during folding modes, the floor portion is lowered so that the number of sheets which can be accomodated increased. In this latter case, due to the folding, mass per unit area of the sheets is relatively large and the effect of the flotation force is essentially non-existent.

A fourth aspect of the present invention features a sheet finisher comprising: a tray, the tray being angled and having at least one upright side wall and a main or an inboard end wall having an aperture; discharge means for discharging a sheet onto the tray; sensing means for sensing the discharge of the sheet by the discharge means onto the tray; a friction roller for engaging the upper surface of the discharged sheet, the friction roller being arranged to rotate within a plane at a predetermined acute angle with respect to the main wall; drive means for driving the friction roller, the drive means including a flexible wire; and guide means for supporting the friction roller and responsive to the sensing means for guiding the friction roller from a home position out through the aperture in the main wall a predetermined time after the sensing means detects the discharge of the sheet, and for guiding the friction roller back to the home position after a predetermined time has lapsed.

In accordance with the fourth aspect of the present invention, a predetermined time after the sensing means detects the discharge of the sheet, the friction roller which is rotatably driven by the flexible wire, is guided out through the opening in the main wall until it assumes a sheet engaging position. The sheet is moved under the influence of the friction roller toward a top corner of the tray. As the plane of rotation of the friction roller defines a predetermined acute angle with respect to the main wall, the sheet is induced to abut against the main wall and one of the side walls and thus become neatly stacked in the corner of the tray. Following this, the friction roller is moved back from its sheet engaging position and returned to its home or original position.

With the the above described operation, it is possible to neatly position a predetermined number of sequentially discharged sheets.

A fifth aspect of the present invention features a sheet finisher which features: a sheet folding section; an upper tray onto which the sheets which are discharged from the folding section are collected; fastening means for fastening together a stack of sheets collected on the upper tray; a lower tray, the lower tray being inclined at a predetermined angle; means for dropping the fastened stack of sheets from the upper tray toward the lower tray; means for determining the number of sheets which have been discharged from the sheet folding section; and lower tray angle control means for changing the angle of the lower tray in response to the sheet number determining means indicating the sensing of a predetermined number of sheets.

In accordance with the fifth aspect of the present invention, when the count of the ejected sheets which have discharged onto the tray has reached the predetermined level, the angle of the lower tray is switched in a manner wherein the entry angle as taken along the vertical line to the upper sheet of the topmost stack, is increased and thus increases the amount of sheets which can be accommodated on the tray and obviates collisions between the stacked sheets and the pile which is being dropped theretoward.

A sixth aspect of the present invention features a sheet finisher comprising: a tray onto which sheets can be discharged and subsequently piled; a fastening device, the fastening device being operatively disposed with the upper tray for fastening the pile of sheets together; a lower tray, the lower tray receiving the fastened stack of sheets which are dropped from the upper one; escape means for permitting the fastened stack of sheets to be selectively slide off the upper tray and drop toward the lower one, the escape means comprising: a pivotal base wall member, the pivotal base wall member being pivotally mounted on a base side of the upper tray; a shutter arrangement which can be pivoted toward the bottom of said upper tray, and driving means for selectively pivoting the pivotal base wall member and the shutter arrangement.

In accordance with the sixth aspect of the invention, after the pile of sheets are fastened together, the pile is released from the upper tray by the pivoting of not only the base wall member for aligning the sheets but also the shutter arrangement toward the lower one under the control of the driving means and in a manner which is not influenced by friction between the stack of sheets and the tray nor by static electricity. Following the release of the stack of sheets the driving means returns the base wall member and the shutter arrangement to their original positions.

A seventh aspect of the present invention features a sheet finisher comprising: a tray onto which sheets can be discharged and piled, the tray being formed with a cut-out at a corner thereof; means for aligning the sheets which are discharged onto the tray with corner of the tray: tray support means for supporting the tray in a manner which permits it to be moved laterally from side to side; a stapler, the stapler being pivotally supported on a shaft; drive means for pivoting the stapler through a predetermined angle toward the cut-out; means for moving synchronously the tray and the stapler; in such a way that the cut-out and an operational position of the stapler mutually closes with each other.

In accordance with the seventh aspect of the invention when the alignment of the sheets with the cut-out portion of the tray which is supported slidably on the tray support means is completed, the tray and the stapler are moved synchronously in such a way that the cut-out portion and an operational position of the stapler mutually closes with each other. When the cut-out portion of the tray and the stapler are suitably located with respect to one and other the stapler is energized to fasten the sheets together. Upon completion of fastening the tray and the stapler are returned to their original positions, respectively.

The above mentioned combination of the laterally movable tray and the pivotal stapler and the associated driving means for the same, is such as to permit the overall construction of the finisher to be rendered compact.

The above and other objects, effects, features and advantages of the present invention will become more apparent from the following description of embodiments thereof taken in conjunction with the accompanying drawings.

DESCRIPTION OF THE PREFERRED EMBODIMENTS

Figure 1:
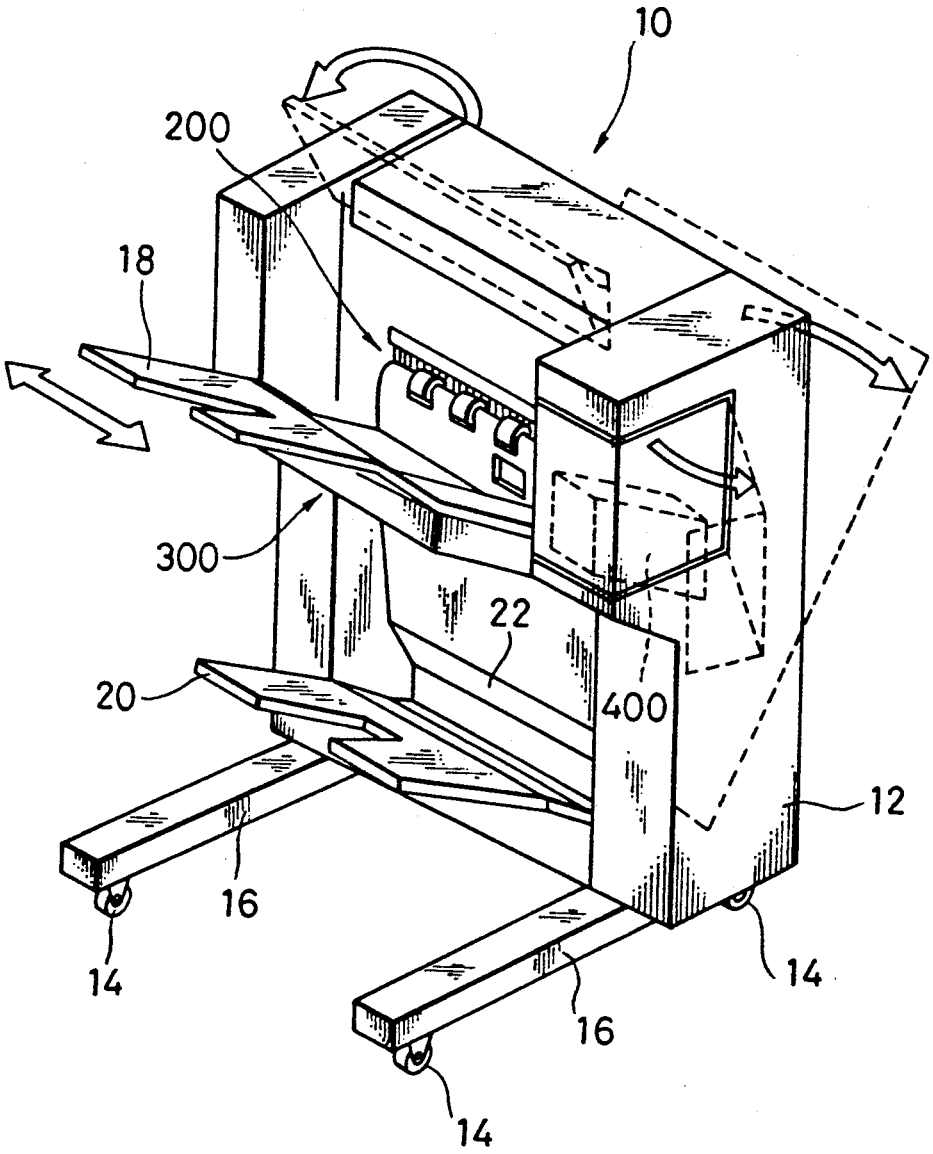
FIG. 1 is a perspective view of an embodiment of a sheet finisher according to the present invention.
Figure 2:
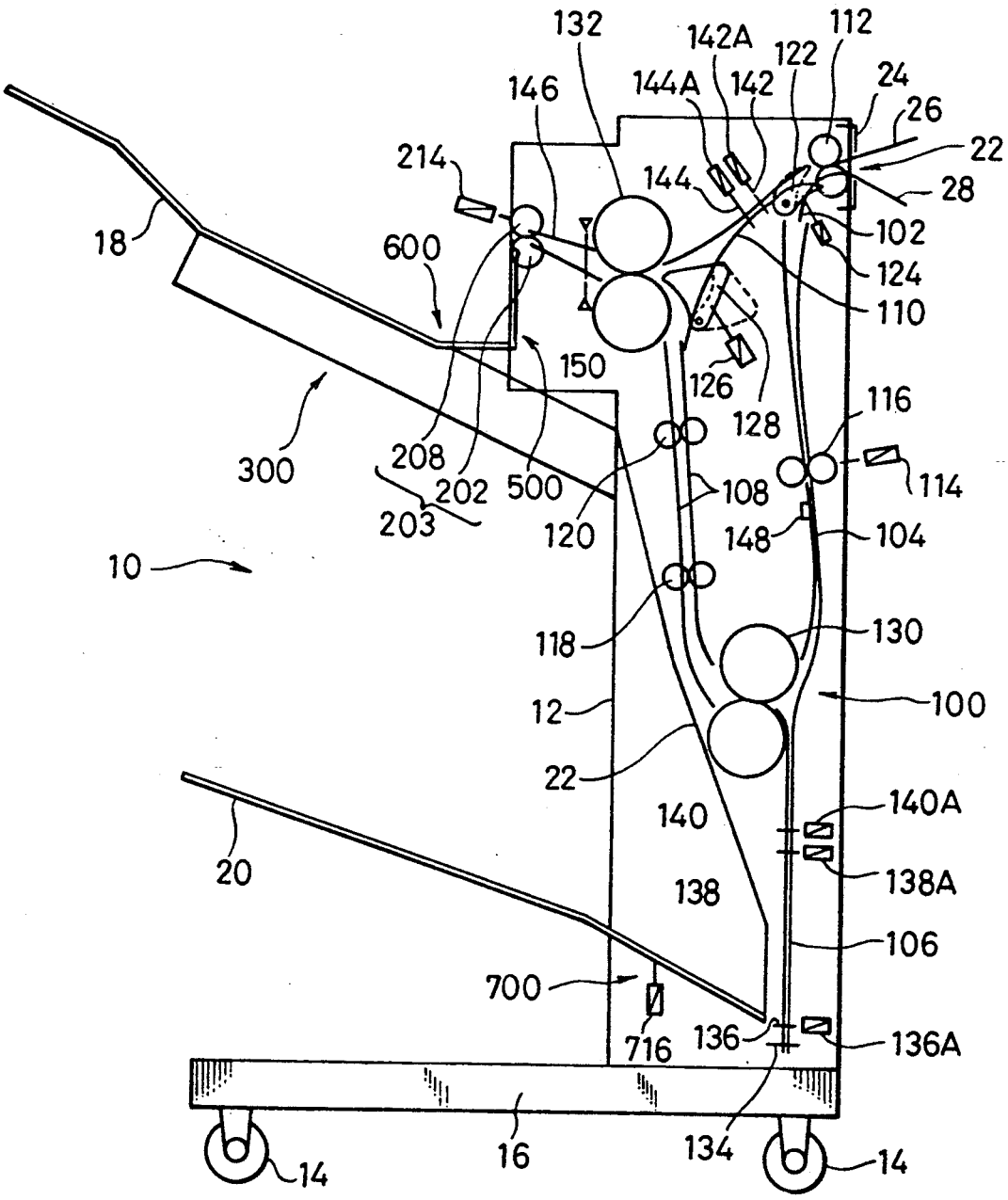
FIG. 2 is a side sectional elevational view showing the constructional characteristics of the embodiment shown in FIG. 1.

As shown in FIGS. 1 and 2 the sheet finisher 10 includes a main body or frame 12 which is moveably supported on four casters 14. As shown these casters 14 are connected to two parallel supports 16 which extend forwardly from the bottom of the main frame.

The main body 12 of the finisher is provided with an upper receiving tray 18 and a lower accumulation tray 20 on which processed sheets or stacks of sheets are collected. A partition plate 22 is arranged to extend along the front of the finisher between the upper and lower trays in the illustrated position.

The instant embodiment is arranged to receive sheets from a non-illustrated photo copy machine or the like and includes a sheet folding mechanism 100; a sheet discharging angle control mechanism 200 which can discharge sheets onto the upper tray 18 at variable angles; a tray shift mechanism 300 for facilitating sheet distribution, a fastening mechanism 400 for fastening together the sheets which are discharged onto the upper tray 18; a sheet aligning mechanism 500 which performs any necessary sheet alignment prior to the fastening operation; an escape mechanism 600 which escapes the sheets processed on the upper tray 18 onto the lower tray 20; and a tray angle control mechanism 700 for increasing storage capability on the lower tray 20.

In the instant embodiment the escape mechanism 600 includes a sheet rise mechanism which is provided to improve the alignment of the sheets on the upper tray.

Each of the above mechanisms will now be discussed in detail.

A. SHEET FOLDING MECHANISM 100

The sheet folding mechanism 100, as shown in FIG. 2 includes a sheet receiving or inlet guide 102; a downwardly extending guide chute 104; a temporary accumulation or accommodation guide chute 106 which continues on from the downstream end of the downwardly extending guide chute 104, and which is arranged to temporarily receive the leading end of a sheet during folding modes of operation; an upwardly extending guide chute 108, a slanted guide chute 110 which is disposed between the upper ends of the upwardly and downwardly extending guide chutes and which is adapted for transferring sheets which are not subject to folding.

The sheet inlet guide 102 is provided with a pair of induction rollers 112. These rollers are located in the mouth of the upper end of the inlet guide 102 which as shown, leads from the inlet opening 22 into which the sheets from the copy machine are fed. The inlet opening 22 is formed with a bracket-like element 24 which supports upper and lower paper guides 26 and 28. The positions of these upper and lower paper guides 26, 28 are adjustable so as to permit the appropriate reception of sheets from a variety of different types of copy machine (not shown).

A first pair of transfer rollers 116 are arranged approximately mid way along the downwardly oriented guide or passage 104. These rollers 116 are operatively connected with an ON/OFF type solenoid 114 which control the nip produced thereby.

The upwardly extending guide chute 108 is provided with a second set (two pairs) of transfer rollers 118 and 120 in the illustrated locations.

A first flapper 122 is provided at the trailing or downstream end of the inlet guide 102 and arranged to selectively guide incoming sheets toward one of the guide chutes 104 and 110 in response to the actuation of a selection solenoid 124.

At the downstream end of the upwardly extending guide chute 108 is provided a second flapper 128 which, in accordance with the energization of a second selection solenoid 126, selectively guides sheets either toward the slanted guide chute 110 or toward a second pair of press rollers 132 which will be described in more detail later.

A first pair of press rollers 130 are provided at the junction of the downwardly extending guide chute 104 and the accommodation guide chute 106. These rollers 130 are arranged to feed the sheets up through the upwardly oriented guide chute 108 toward a second pair of press rollers 132 which are located at the downstream ends of the upwardly oriented guide chute 108 and the slanted guide chute 110.

The temporary accommodation guide chute 106 is provided with a plurality of stoppers 134 136, 138 and 140 which are arranged to engage the leading edges of the sheets depending on the size and the folding of the same.

More specifically, an A3H stopper 134 is arranged to engage A3 size sheets and is fixedly located at the bottom of the accommodation guide chute 106. On the other hand, a B4H stopper 136 is arranged to cooperate with B4 size sheets which are undergoing half folding; a A3Z stopper 138 is arranged to engage A3 size sheets which are undergoing Z folding; and a B4Z stopper 140 is arranged to engage B4 sheets which are undergoing Z folding.

Solenoids 136A, 138A and 140A are arranged to selectively induce the stoppers 136, 138 and 140 to project into the accommodation guide chute 106 upon energization.

The slanted or angled guide 110 is provided with a A3Z stopper 142 which is arranged to engage A3 size sheets which are undergoing Z folding, and a B4Z stopper 144 which is arranged to contact B4 size sheets which are undergoing Z folding. These stoppers are operatively connected with solenoids 142A and 144A in a manner to be selectively projected into the guide chute 110 in response to solenoid energization.

It should be noted that a guide element 146 is disposed on the output side of the second pair of press rollers 132 and arranged to cooperate with a pair of later described discharge rollers 203.

In addition to this, sensors 148 and 150 which are arranged to detect sheet arrival and transfer, are arranged downstream of the first pair of the transfer rollers 116 and second pair of press rollers 132, respectively. In this embodiment of the present invention, sensor 148 takes the form of reflected light beam photo sensor while sensor 150 taken the form of a trip sensor which responds to a beam of light being interrupted.

B. VARIABLE ANGLE SHEET DISCHARGING MECHANISM 200

Figure 3:
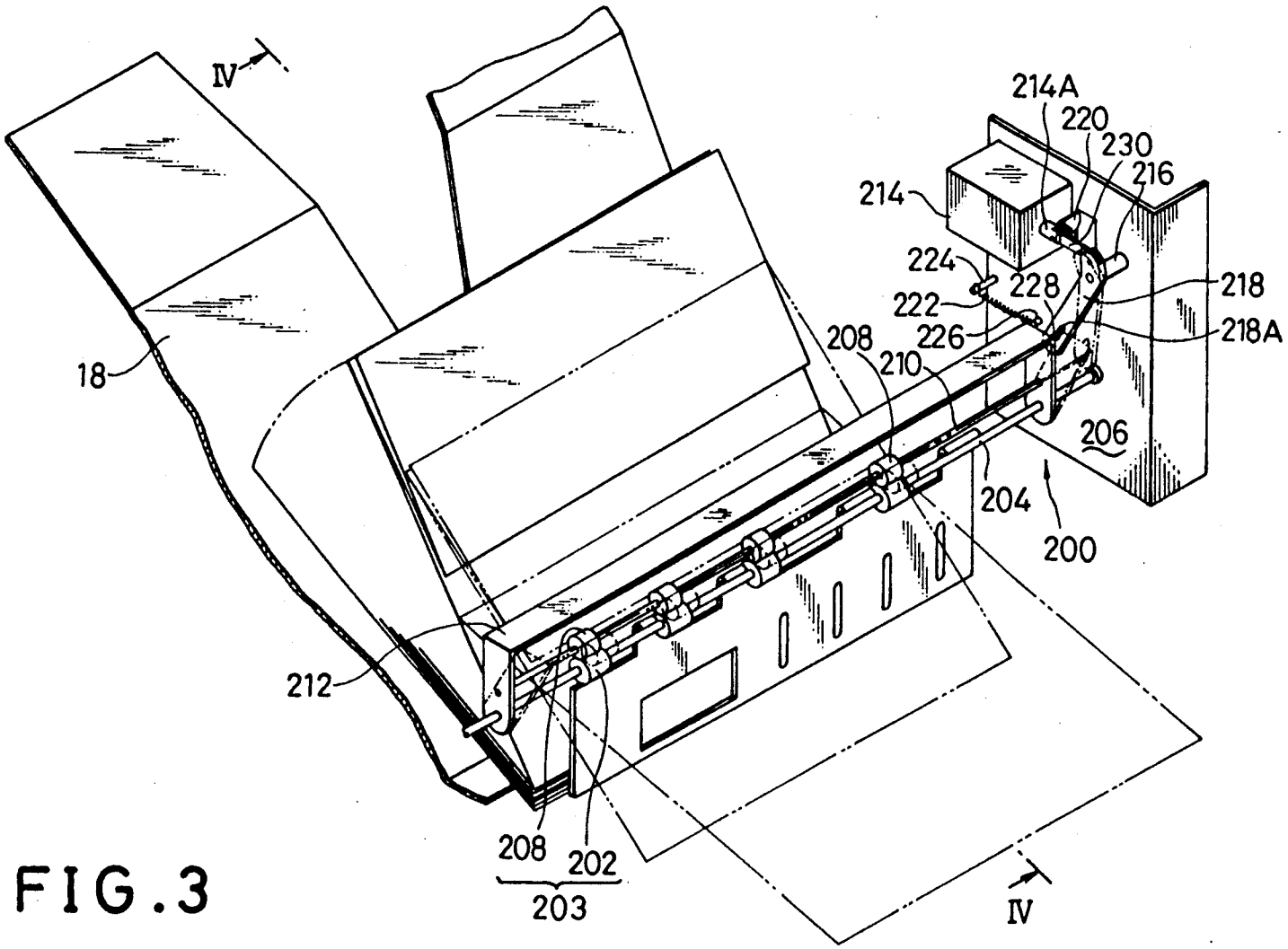
FIG. 3 is a perspective view showing the arrangement of a device which varies the angle at which the sheets are ejected.
Figure 4:
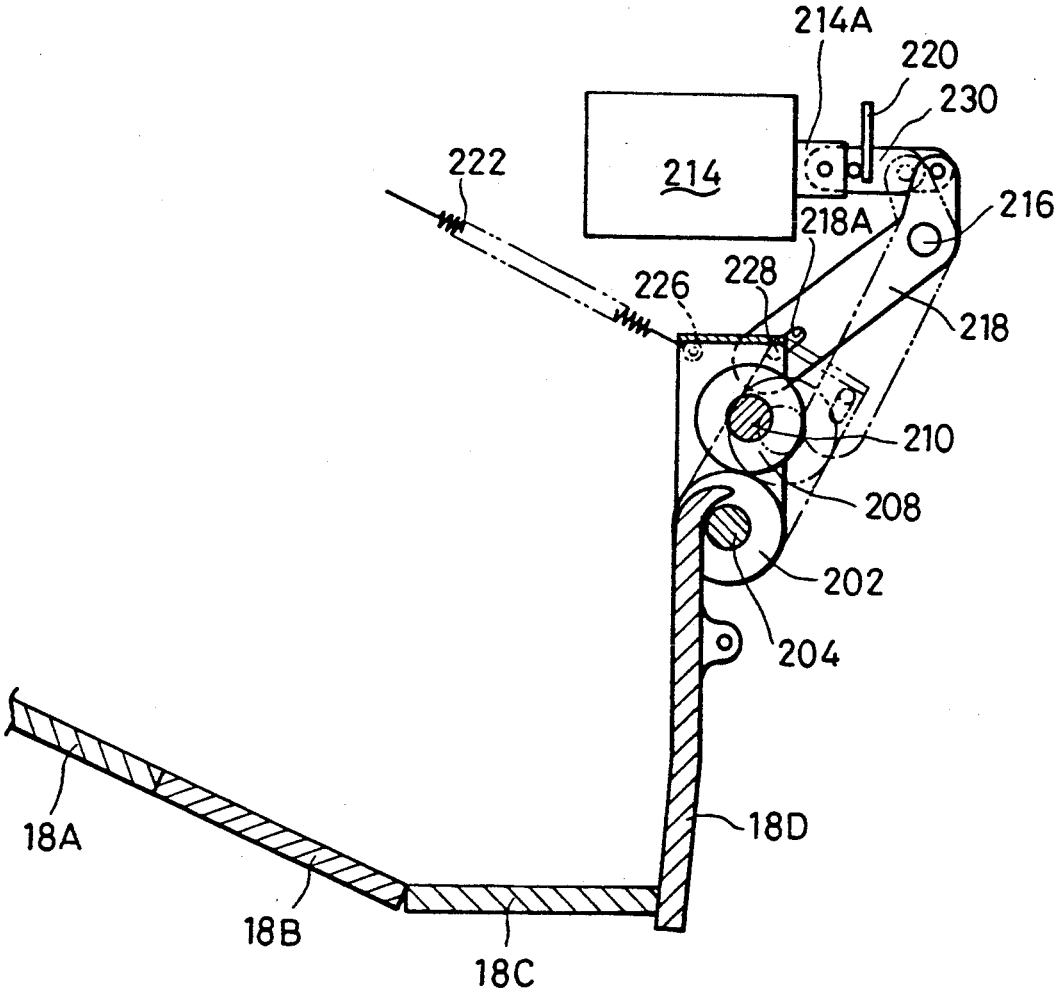
FIG. 4 is a sectional view as taken along section line 4 of FIG. 3.

FIGS. 3 and 4 show the construction and arrangement of the mechanism 200 which enables the sheets to be discharged at variable angles.

A plurality of discharge rollers 202 (see FIG. 3) are mounted on a rotatably driven shaft 204 which is supported on a bracket 206. This bracket 206 is fixedly connected to the frame of the main body of the finisher. A plurality of pinch rollers 208 are each arranged to engage one of the discharge rollers 202. These pinch rollers 208 are mounted on a rotatable shaft 210 which is supported on a bracket 212. In this instance the bracket 212 is pivotally supported on the shaft 204.

The above mentioned discharge rollers 202 and the pinch rollers 208 will be simply referred to as discharge roller pair 203 hereinafter.

A solenoid 214 and a support shaft 216 are fixed to the bracket 206. An bell-crank shaped arm 218 which is formed with a slot 218A, is pivotally supported on said support shaft 216. The bracket is formed with a stopper projection 220 and a support pin 224. A spring 222 is arranged to extend between the support pin 224 and a pin 226 which is arranged to project from the pivotal bracket 212. The bracket 212 is formed with a pin 228 which is arranged to be received in the slot 218A formed in the arm 218.

An actuator rod 214A of the solenoid 214 is provided with a pivotal plate 230 which interconnects the actuator rod 214A with the upper end of the arm 218.

With the above described arrangement, depending on the dimensions of each of the elements comprising the same, the contact points defined between the discharged rollers 202 and the pinch rollers 208 which control the angle with respect to the horizontal at which the sheets are discharged is determined by the energization of the solenoid 214. Viz., when the solenoid 214 is de-energized Q1=10 degrees while when the solenoid is energized Q2=30 degrees. It should be noted that in this case the center portion of the upper tray 18 is arranged at 30 degrees with respect to the horizontal.

When the solenoid is de-energized, the spring 222 exerts attractive force which pulls the bracket 212 in a manner which induces the arm 218 to rotate to the position shown in FIG. 4 and induce the actuator rod 214A to engage the stopper projection 220. Under these conditions, the initial discharge angle Q1 is set at approximately 10 degrees.

C. TRAY SHIFT AND FASTENING MECHANISMS 300 and 400

Figure 5:
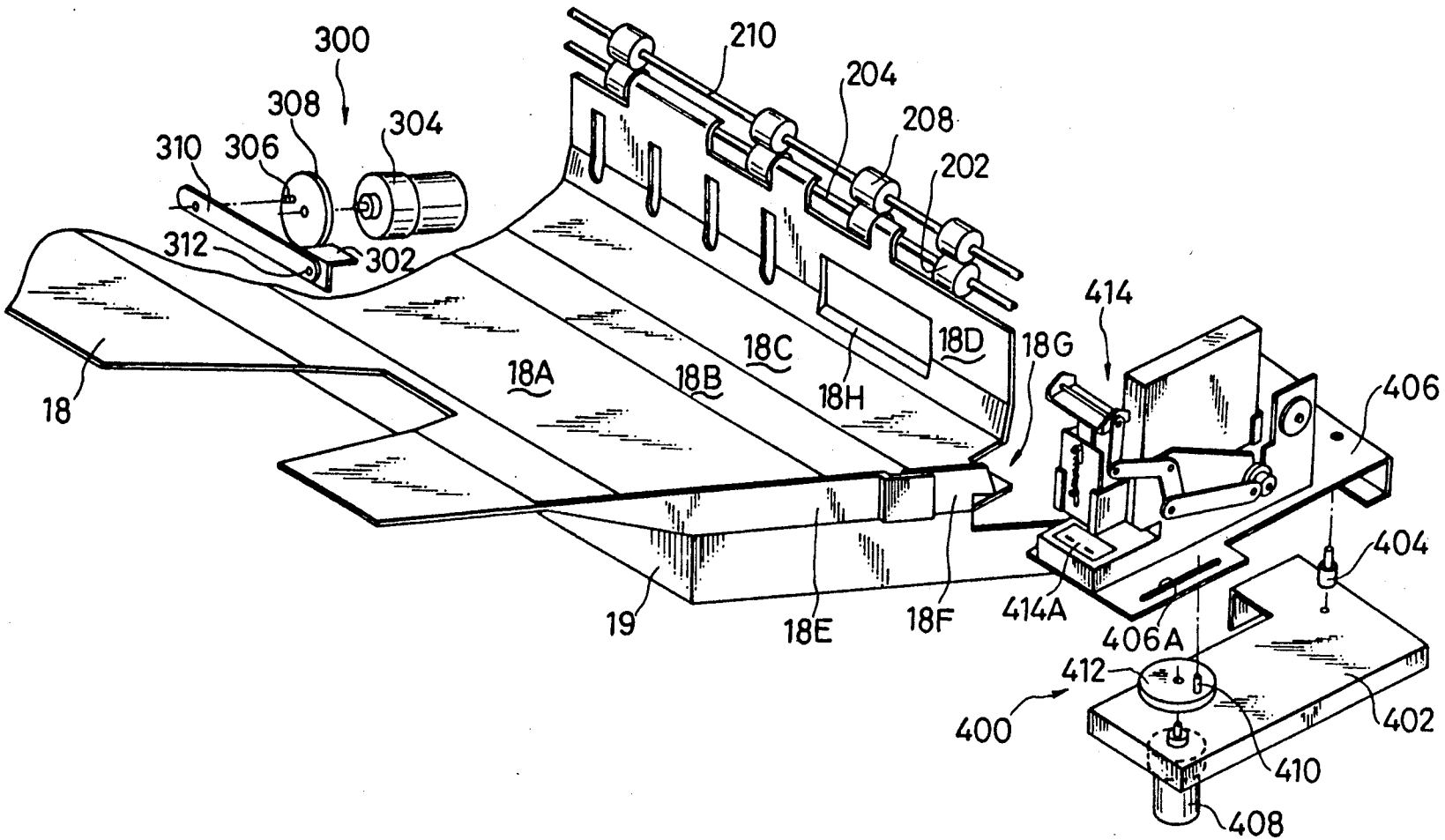
FIGS. 5 and 6 are perspective view showing parts of a tray shift mechanism and an associated fastening mechanism.
Figure 6:
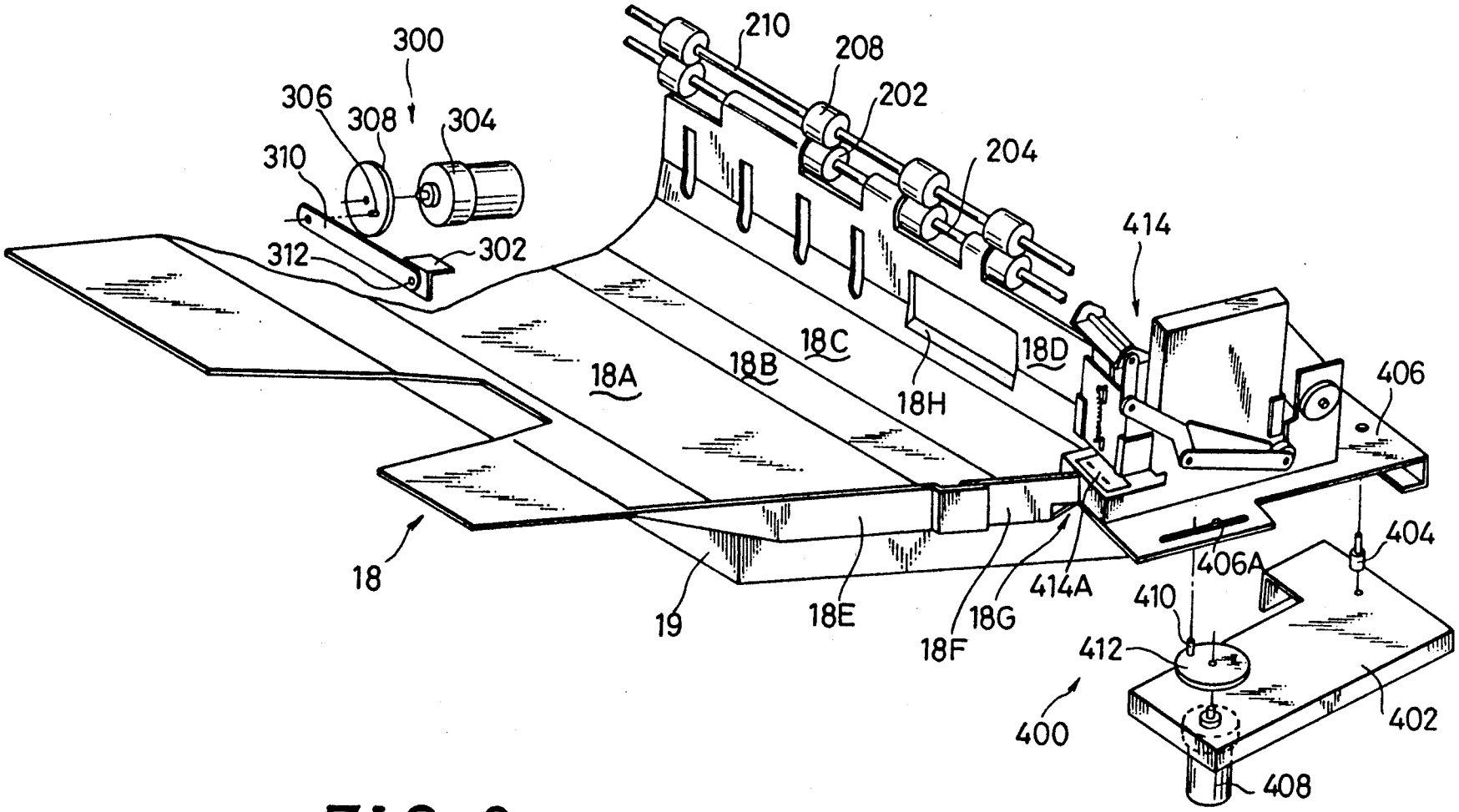

FIGS. 5 and 6 show the construction and arrangement of tray shift mechanism 300 and the fastening device 400.

A bracket 302 is fixed to the lower surface of the upper tray 18 in the illustrated position. An electric motor 304 is supported on the chassis of the finisher to one side of the upper tray 18. A pin 306 is arranged to project from the face of cam wheel 308 which is operatively connected with the motor 304. A connection plate 310 is operatively connected at its outboard end to the pin 306 and to the bracket 302 at its inboard end.

With this arrangement with each 180 degrees of rotation of the cam wheel 308, the upper tray 18 is induced to move from left to right and then right to left.

The fastening mechanism 400 is located to one side of the upper tray and supported on main frame of the finisher by way of a bracket 402. A pin 404 which is extends from the upper face of the bracket 402 supports a base plate 406 of the fastening mechanism.

An electric motor 408 is fixed to the lower face of the bracket 402. A pin which extends from the face of cam wheel 412 in drive connection with the motor 408, is arranged to be received in a slot 406A formed along one edge of the base plate 406.

A stapler 414 is disposed on the upper face of the base plate 406. In response to half a rotation of the cam wheel 412, the connection between the pin 410 and the slot 406 induces the stapler to move into the cut out 18G formed in the upper tray in a manner to assume the position shown in FIG. 6.

D. SHEET ALIGNING MECHANISM 500

Figure 7:
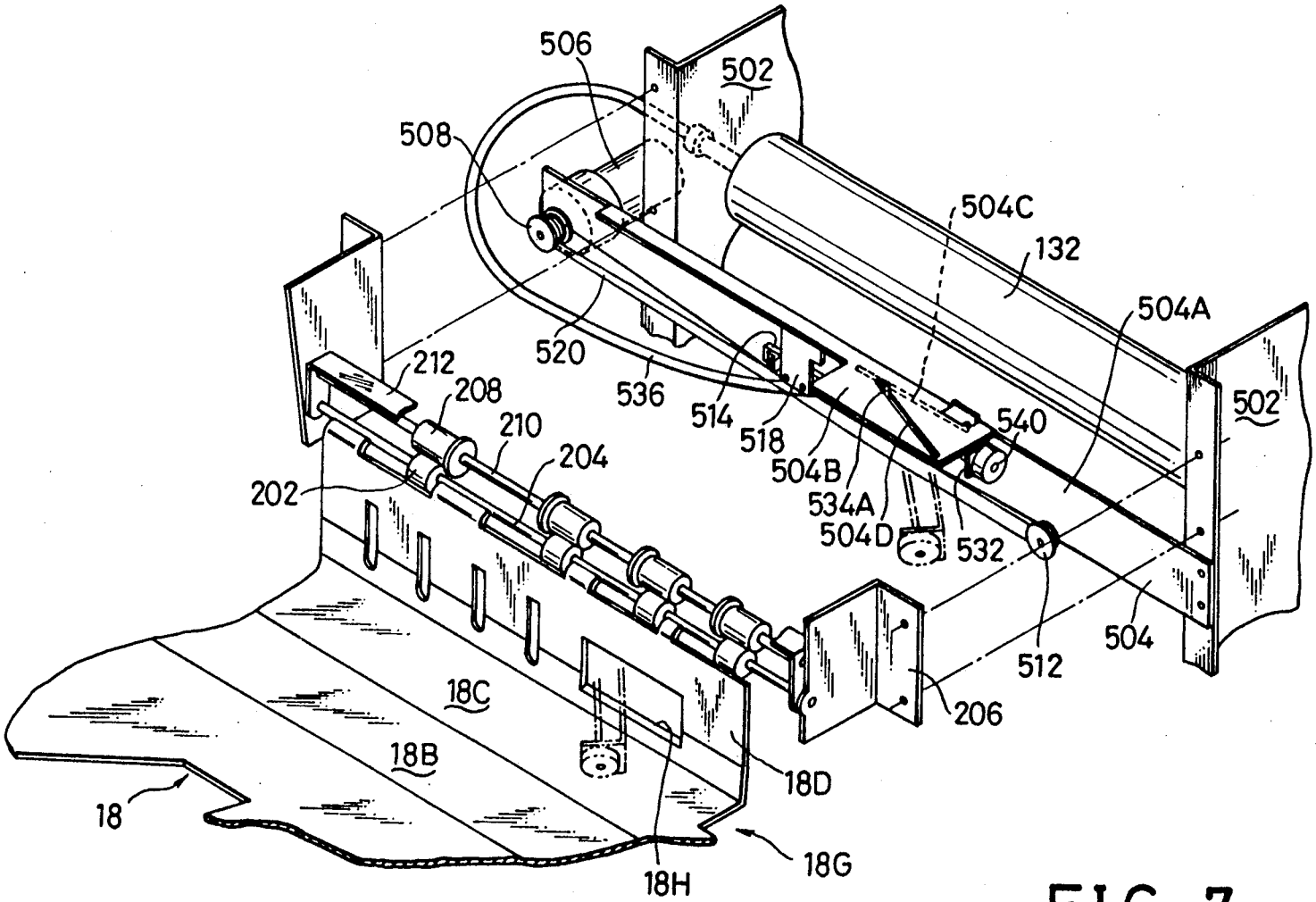
FIG. 7 is a perspective view showing a sheet aligning device wherein the device which varies the sheet discharging angle has been omitted for the sake of illustrative clarity.
Figure 13:
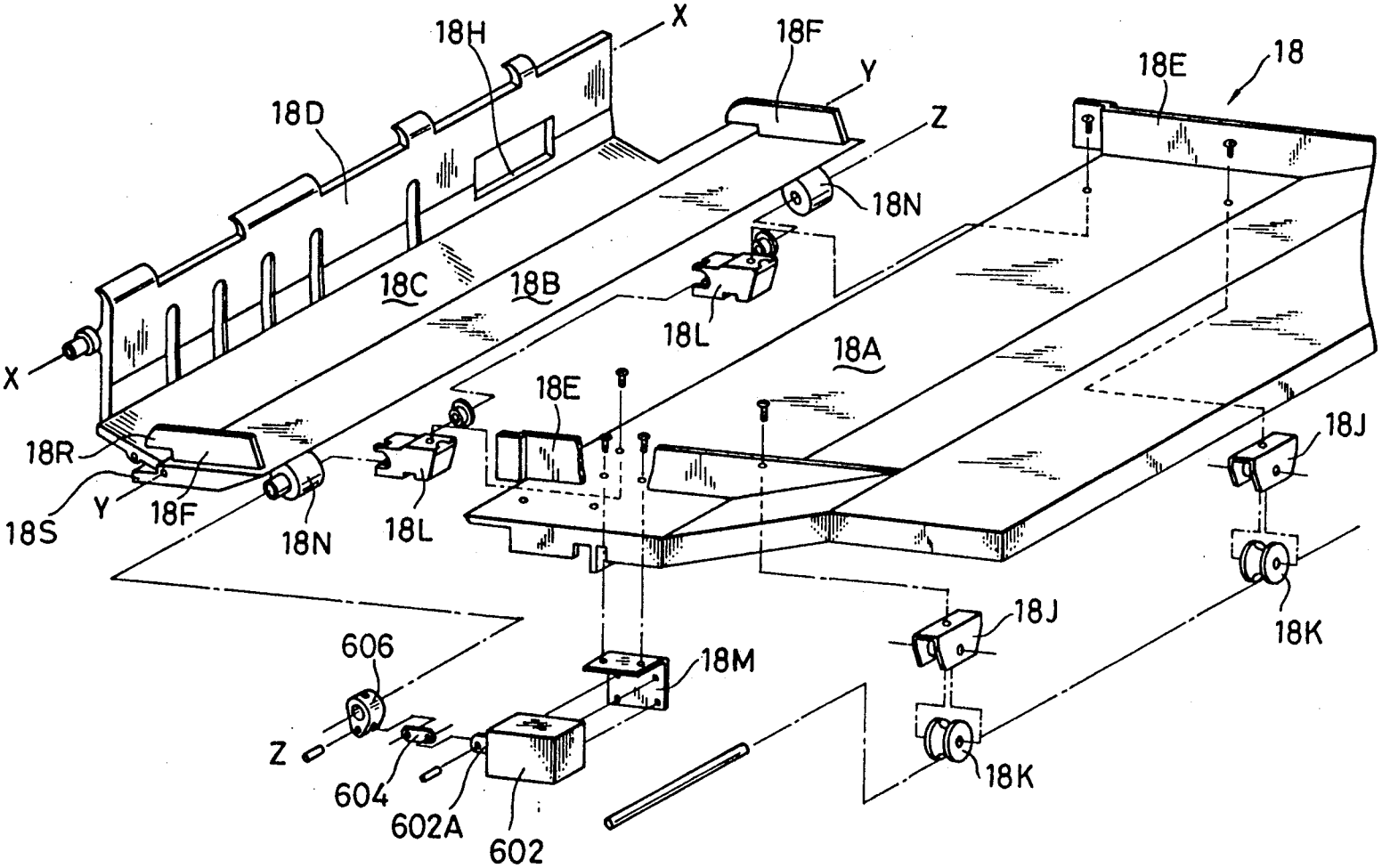
FIG. 13 is a perspective view showing the construction of an upper tray used in the instant embodiment.

Before proceeding with a description of the sheet aligning mechanism, it is deemed advantageous from the point of ready understanding, firstly to briefly consider the arrangement of the construction of upper tray 18 shown in FIGS. 7 and 13. Note that a full description will be made of these particular constructions later in this instant disclosure.

The upper tray 18 is composed of four main elements. Viz., a main portion 18A, a flap section 18B, a door section 18C and a gate plate section 18D. The tray further includes side sill portions 18E and 18F which are formed integrally with the main portion 18A and the flap section 18B, respectively, and which are arranged to be perpendicular to the gate plate 18D in the manner illustrated in FIG. 13.

The door section 18C and the gate plate 18D are arranged to be selectively opened and closed in a manner which will be detailed later in the disclosure.

The gate plate 18D is formed adjacent to the previously mentioned cut out 18G with a opening 18H through which a friction roller 540, which forms part of the aligning mechanism 500, can be passed and induced to extend over the upper face or the upper tray during aligning operation.

Referring now to FIGS. 7 to 11 it will be seen that the second set of press rollers 132 are supported by side frames 502. A support bracket 504 is supported on these side frames 502 and arranged to extend laterally therebetween. This bracket has partially an L shaped cross section and is comprised of an essentially vertical side portion 504A and an essentially horizontally extending upper portion 504B.

A guide channel 504C is formed in the side portion 504A at a level just below the upper edge thereof. The right hand end (as seen in the drawings) of this channel is arranged to curve upwardly. The upper portion 504B is formed with a guide slot 504D. An electric motor 506 is mounted at one end of the side portion 504A in a manner wherein a pulley 508 which is in drive connection with the motor, is located in the illustrated position. A second pulley 512 is rotatably supported on the side portion 504A by way of a bracket 510 (see FIG. 8).

Figure 8:
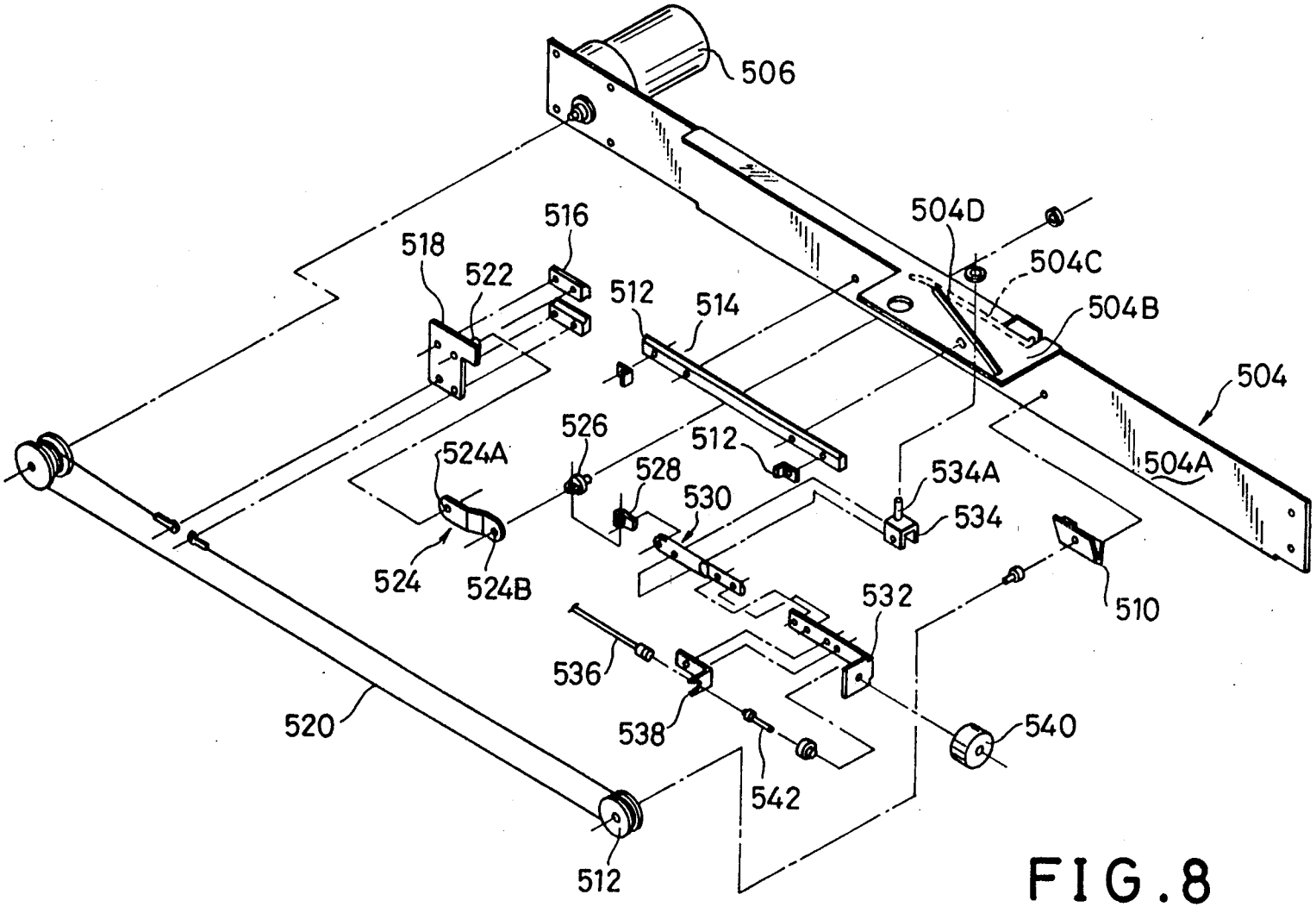
FIG. 8 is a perspective view showing details of the arrangement depicted in FIG. 7.

Further, as shown in exploded form in FIG. 8, a rail 514 which has stoppers 512 provided at opposite ends is fixed to the side portion 504A. This rail 514 is arranged to receive a slider arrangement 516 which is fixed to a support plate 518. The support plate 518 is connected to the ends of a wire 520 which extends between and which is wound on the above mentioned pulleys 508 and 512. The support plate 518 is further formed with a pin 522 which is disposed through an opening 524A formed at one end of a link plate 524 in manner to pivotally support the same. The other end 524B of the link plate 524 is a formed with an aperture through which a grommet-like pin 526 is disposed.

Figure 9:
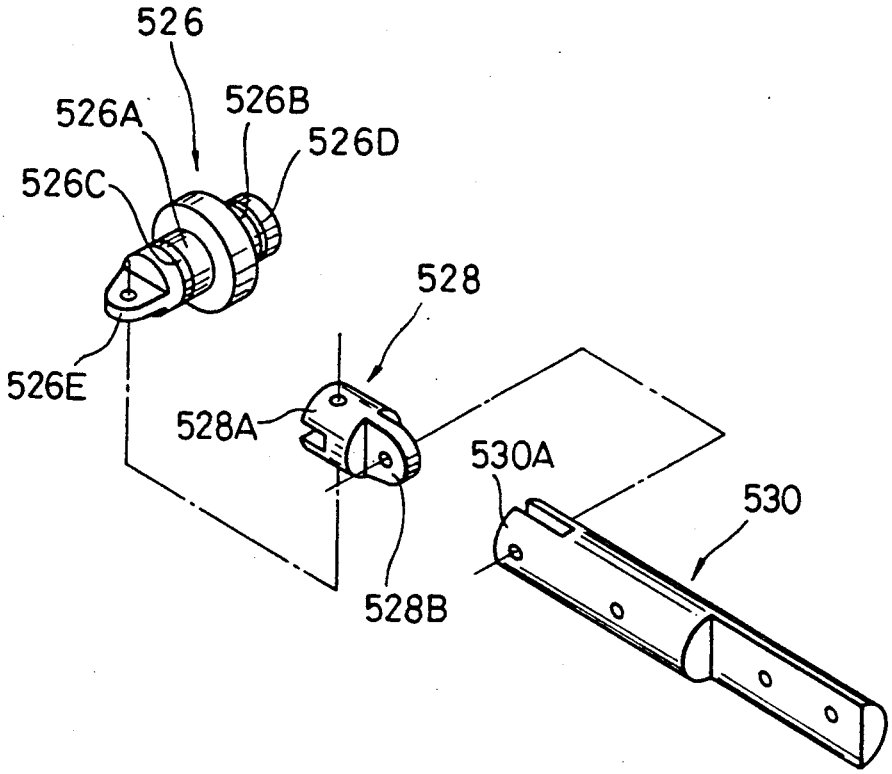
FIG. 9 is a perspective view showing an enlargement of a portion of the arrangement shown in FIGS. 7 and 8.
Figure 10:
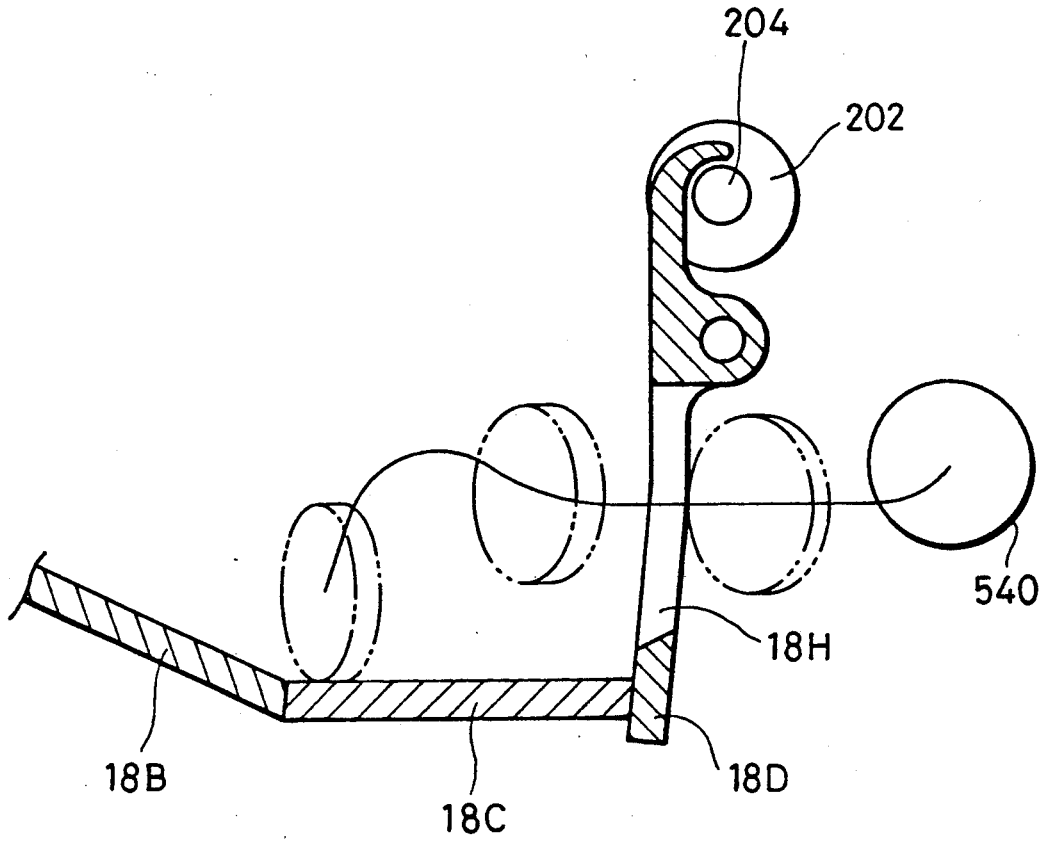
FIG. 10 is a side sectional view of a gate plate section which depicts the movement of a friction roller which forms part of the present invention.

As best seen in FIG. 9 this grommet-like pin which forms the first joint of a universal joint arrangement, comprises a circular shaft portions 526A and 526B in which snap ring receiving circular channels 526C and 526D are respectively formed. A large diameter portion (no numeral) is defined between the shaft portions 526A, 526B and arranged to engage the rear face of the link plate 524.

One end of the grommet-like pin 526 is formed with a tongue portion 526E which is arranged to receive a yoke member 528B. This yoke forms part of a member 528 which defines a second joint of the universal joint arrangement, is pivotally connected to the tongue 526E by way of pin (not shown). The first end of a connection member 530 is formed with a yoke 530A which receives a tongue portion 528B formed on the element 528. The second end of the connection member 530 is connect to an L-shaped arm 532 while the mid portion is pivotally connected to a U-shaped connector 534. This connector 534 is formed with a pin 534A which is arranged to be slidably received in the above mentioned guide slot 504D.

The L-shaped arm 532 is operatively connected with one end of a flexible wire 536 by way of connection bracket 538 and further arranged to rotatably support a friction roller 540. In this embodiment the roller 540 is fixed to a rotatable shaft 542 which is connected to the end of the wire 536.

As shown in FIG. 7, the other end of the flexible wire 536 is connected to the shaft of one of the press rollers 132 and thus provides a drive connection which produces simultaneous rotation of the two rollers.

The electric motor 506 is arranged to rotate pulleys 508 and 512 when energized and thus induce the situation wherein the pin 534A is induced to slide along the guide slot 504D and causes the friction roller to move in the manner illustrated in FIG. 7 via the pivoting of the arm 532 and the connection member 530 about the universal joint.

As the movement of guide plate 518 continues to the right (as seen in the drawings) element 526 of the fist joint slides along the guide channel 504C. Accordingly, with this arrangement the friction roller can be moved in the manner illustrated in FIG. 10 wherein the height of the roller is maintained and it can pass through the opening 18H formed in the gate plate 18D. Then, the element 526 of the first joint which is guided by the guide channel 504C rises up in accordance with the curved shape of the guide channel 504C at right hand end so that the arm 532 and the connection member 530 integrally rotate about the pivot of the U-shaped connector 534. As a result, the friction roller goes down so as to contact the upper surface of the upper tray 18 in the manner illustrated in FIG. 10.

In the illustrated embodiment the friction roller 540 is arranged to assume a position wherein the plane of rotation thereof defines an angle of about 15 degrees with respect to the face of the gate plate 18D.

Figure 11:
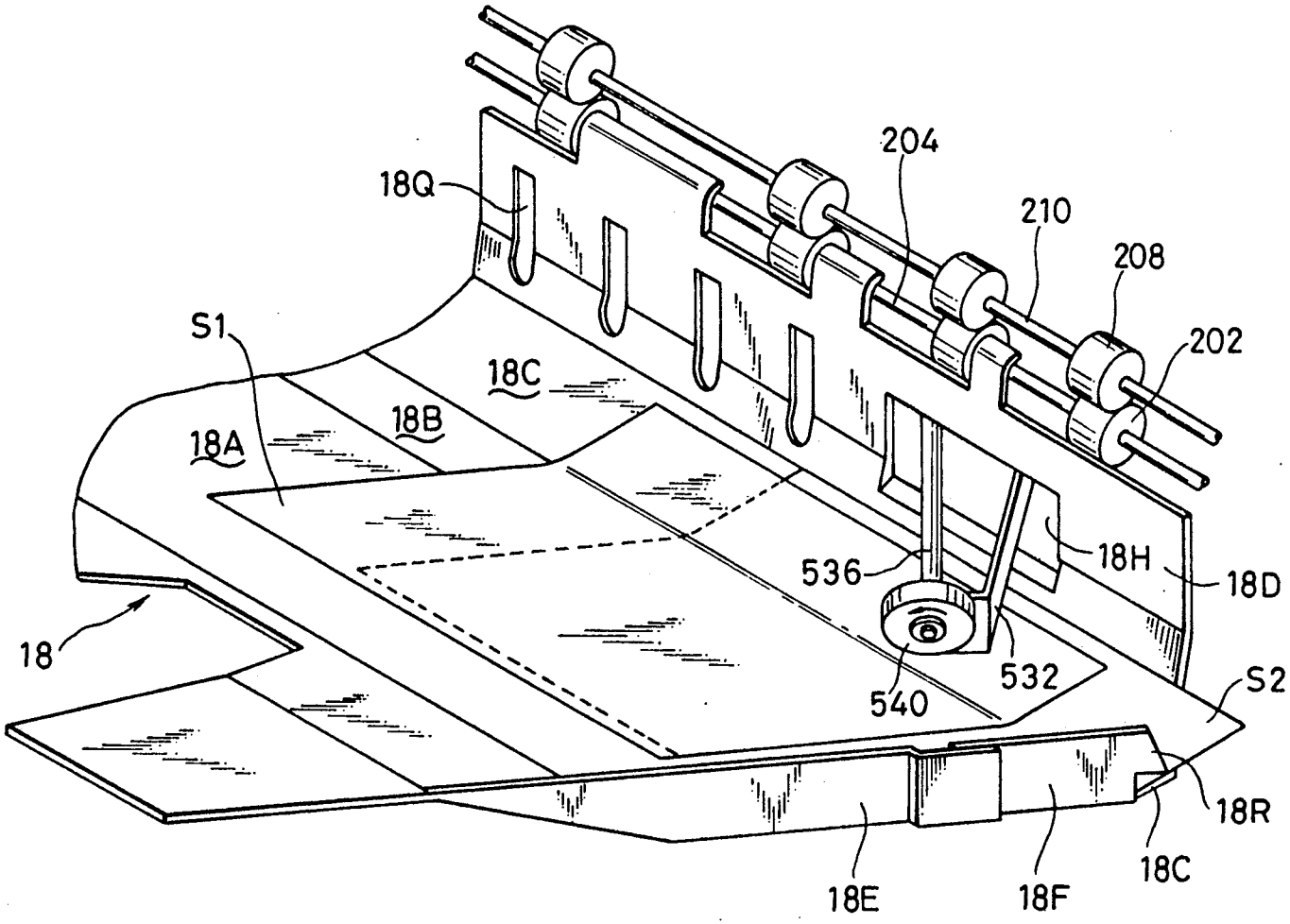
FIG. 11 is a perspective view showing the positional relationship of a friction roller with respect to the upper surface of a tray.

Assuming that a discharged sheet lays in the state S1 as shown in FIG. 11 the discharge sheet will abut on the side sill 18F of the upper tray 18 and the gate plate 18D in response to the rotation of the friction roller 540 so as to be aligned in the state S2.

It should be noted that in order to prevent the sheet from curling due to engagement with the upper surface of the tray, the tray preferably has depressions in the vicinity of the location where the friction roller engages the same to allow the sheet to be bent downwardly.

E. TRAY RISE AND ESCAPE MECHANISM 600

Figure 12:
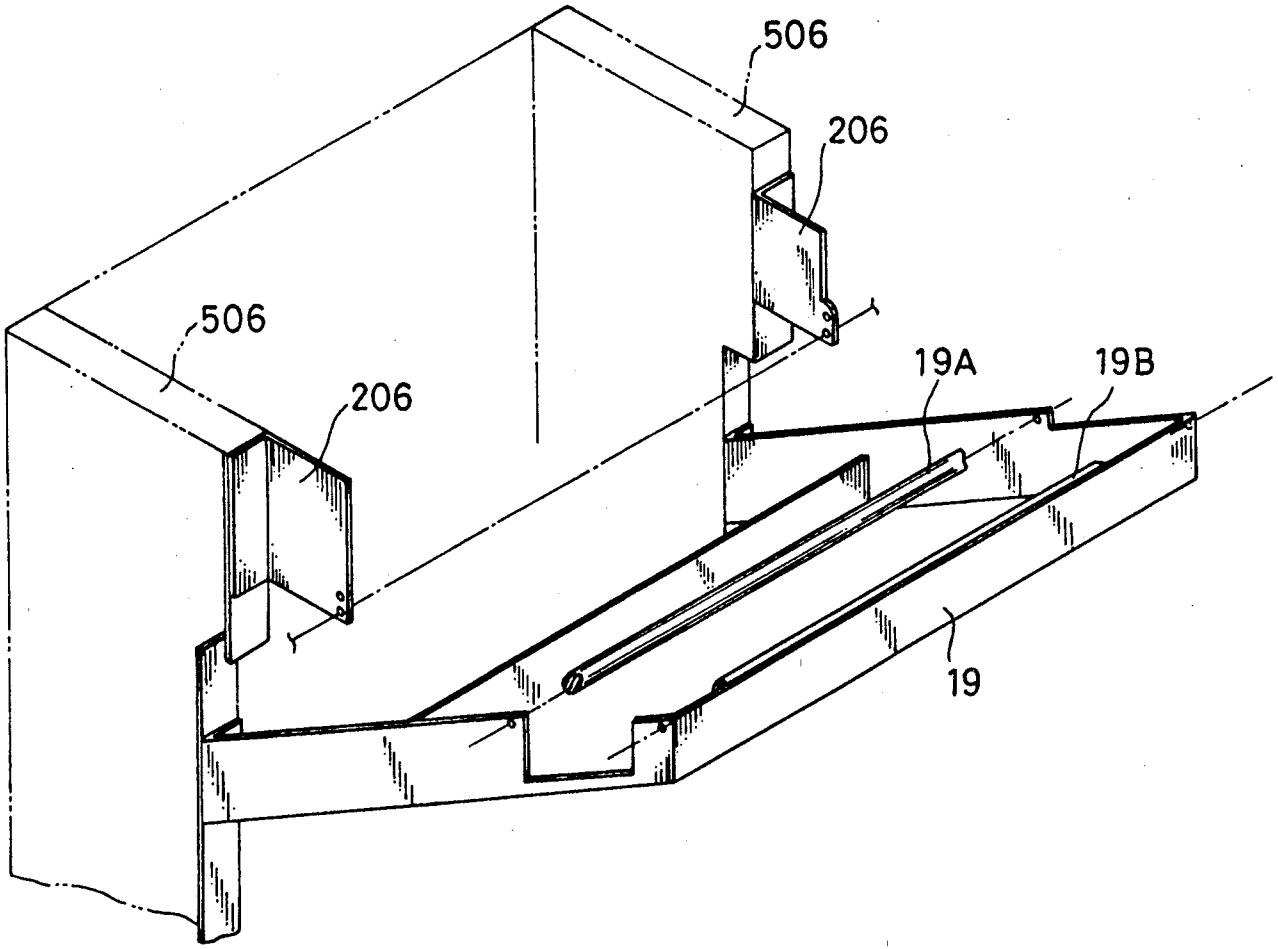
FIG. 12 is a perspective view showing the positional relationship of a tray chassis which forms part of the instant embodiment.

As shown in FIG. 12 the upper tray is disposed on top of a tray chassis which is rigidly connected with the main frame 506 of the finisher.

The tray chassis 19 is provided with two guide bars 19A and 19B.

FIG. 13 shows the upper tray 18 in detail. As shown, brackets 18J connected to the lower surface of the upper tray 18, support rollers 18K which are arranged to roll along the guide bar 19B of the tray chassis 19. A bracket 18M is connected to the lower surface of the upper tray 18 and arranged to support a solenoid 602 while blocks 18L which are fastened to the same surface are arranged to pivotally seat on the guide bar 19B.

Boss portions 18N which are formed integrally on the lower face of the flap section 18B are arranged to receive the guide bar 19A the axis of which is indicated by the phantom line Z.

Actuator rod 602A of the solenoid 602 is connected by way of a connection plate 604 to an arm member 606 which is pivotally mounted on one of the boss portions 18N.

Figure 14:
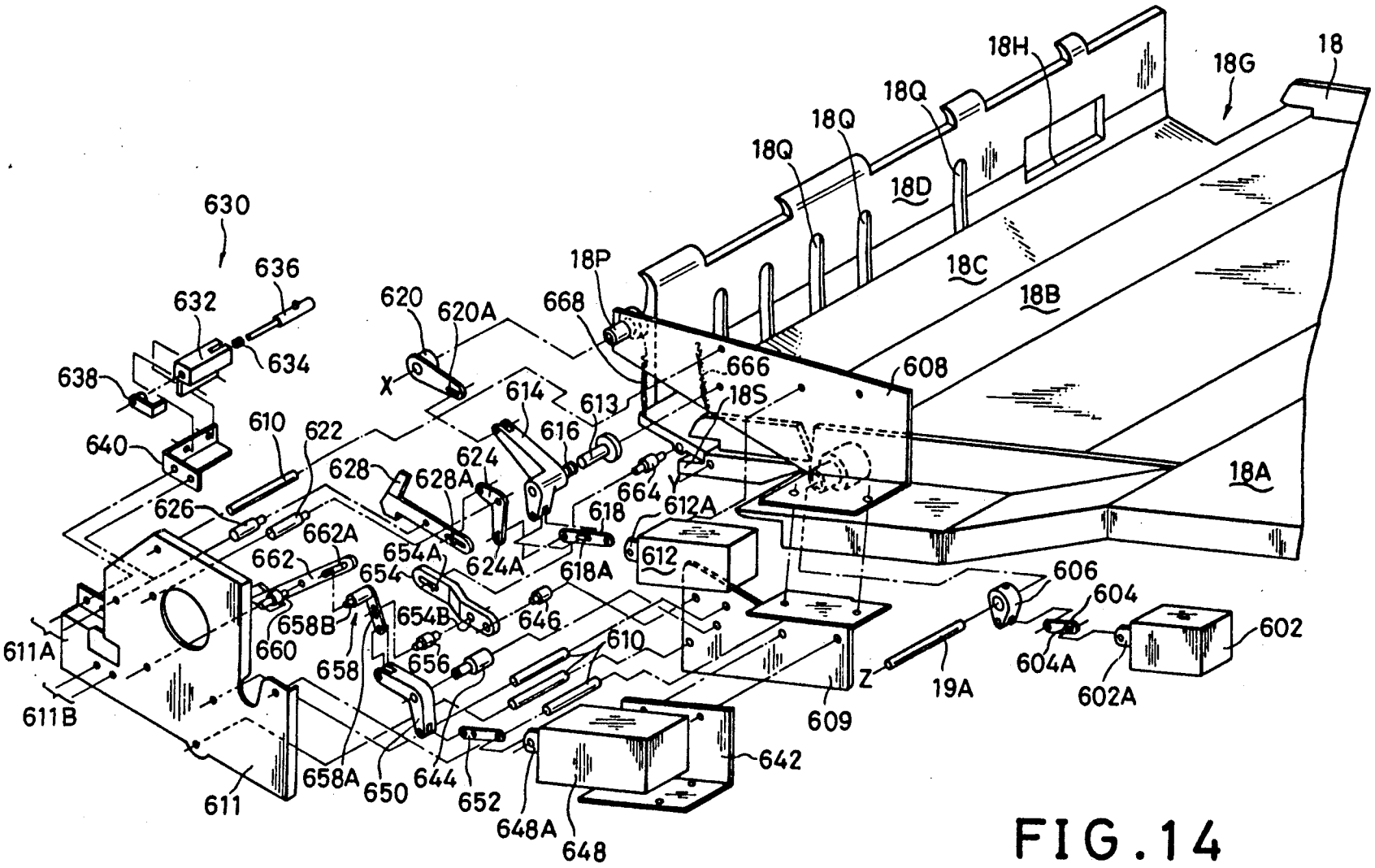
FIG. 14 is a perspective view showing a rise device and an escape device which are associated with the upper tray of the instant embodiment.

As shown in FIG. 14, the flap section 18B and the door member 18C are connected so as to be relatively rotatable about the axis Y. Note however, that the flap section 18B has a tongue portion 18S which extends beyond the level of the Y axis and that the door portion 18C and the flap section 18B define a single surface and the two elements are prevented from mutual rotation.

Further, the main body 18A of the tray is provided with a first bracket 608 on which the gate plate 18D is rotatably supported by an integrally formed boss portion 18P. This bracket 608 is connected to the upper surface of the upper tray 18 as shown. The main body 18A is further provide with second bracket 609 which is connected at the same location but on the lower surface thereof. This second bracket 609 is formed with a plurality of studs 610 which are arranged at predetermined intervals and which have predetermined lengths. A bracket 611 is supported on the outboard ends of the studs 610.

Solenoid 612 is fixed to the first bracket 608, a first pin 613 is also provided. This first pine 613 rotatably supports an arm member 614 which is biased by a spring 616 to rotate in the clockwise direction.

One end of the arm 614 is connected with a connection plate 618 which is formed with a slot 618A. The other end of the arm 614 is connected to an arm 620 which is fixed on the boss portion 18P of gate plate 18D.

The connection plate 618 has one end connected to the actuating rod 612A of the solenoid 612. The other end is connected to a slot 624A of a bell crank 624 which is pivotally supported on a pin 622 extending from the third bracket 611.

This bell crank 624 has its other end connected to a slot 628A which is formed in a cancelling arm 628. This arm 628 is pivotally supported on a pin 626 which extends from the third bracket 611.

A lock mechanism 630 includes a housing 632 in which an actuator rod 636 is disposed and subject to the bias of a compression spring 634. One end of the actuator rod 636 is connected to a finger-like catch member 638. The instant embodiment is provided with two such lock mechanisms 630A and 630B.

That is to say, the first lock mechanism 630A is mounted at a first site 611A on the third bracket by way of bracket 640 in a manner to control the position of the gate plate 18D. The second lock mechanism 640B is mounted by way of a non-illustrated bracket at a second site 611B on the third bracket 611 in a manner to control the movement of the door member 18C.

One end of the above mentioned release arm 628 is engaged with the catch member 638. In response to the rotation of the arm 628 in the clockwise direction, the actuator rod 636 is induced to enter into the housing 632.

The second bracket 609 is provided with fourth and fifth pins 644, 646 and further serves to support a bracket 642 on which a solenoid 648 is mounted.

The actuator rod 648A of the solenoid 648 is connected by way of a connection plate 652 to one end of a bell-crank 650. The latter is pivotally mounted on the fourth pin 644.

An arm 654 is pivotally mounted at one end on the fifth pin 646. This arm is formed with slot 654A and a through hole 654B. A sixth pin is disposed in the hole 654B and arranged to project toward the third bracket 611.

The other end of the bell crank 650 is connected with one end of an arm 658. The middle of this arm 658 id formed with a slot 658A which receives the sixth pin 656. A seventh pin 658B is provided at the other end of the arm 658 and arranged to be slidably received in a slot 662A which is formed at a first end of a second lock release arm 662. The latter element is pivotally mounted on the third bracket 611.

The second lock release arm 662 is formed with a projection at the second end thereof and arranged to be rotatable in the corner clockwise direction in a manner which moves the projection into a position which cancels the locking action of the second lock mechanism 630B.

A ninth pin 664 which is mounted on the side wall of the door portion 18C is received in the slot 654A which is formed in the arm 654.

It should be noted that second and third springs 666 and 668 extend between the flap section 18B and the first bracket 608 and between the door portion 18C and the first bracket 608.

F. TRAY ANGLE CONTROL MECHANISM 700

Figure 16:
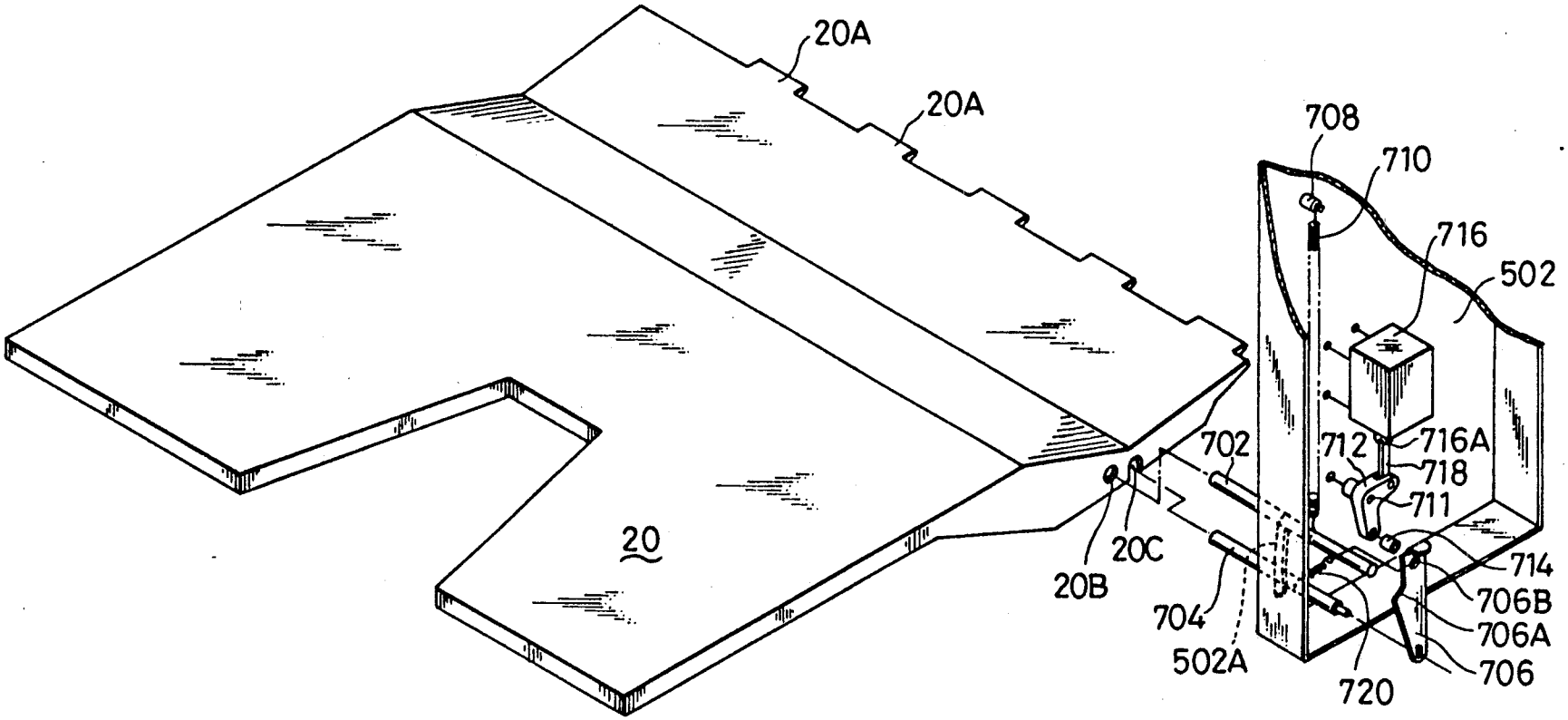
FIG. 16 is the angle varying device which is associated with the lower tray of the instant embodiment.

As shown in FIG. 16, the lower tray 20 is formed with a plurality of tabs 20A along the inboard edge, a through hole 20B and a cut out 20C in the side wall portion thereof. A rod 702 is arranged to be inserted into the hole 20B while a shaft 704 is arranged to be received in the cut out 290B. The tabs 20A are arranged to be received in apertures (not shown) formed in the partition plate 22. The inboard end of the lower tray is arranged to act as the axis about which the tray can hinge.

The shaft 704 is rotatably supported on the main frame 502 and connected at the outboard end to a hook plate 706. The rod 702 is arranged to pass through an arcuate slot 502A formed in the main frame 502 of the finisher and to engage at the outboard end with a step or shoulder portion 706A formed in the hook plate 706.

The rod 702 is resiliently connected to the main frame 502 by a spring 710 which is connected at its upper end to a pin 708. The spring is arranged to normally bias the rod 702 in a manner wherein it engages the upper end of the arcutate slot 502A.

The hook plate 706 is formed with a through hole 706B at the upper end thereof via which it is pivotally connected via a collar 714 to one end of a bell crank 712. As shown the bell crank 712 is pivotally supported on the main frame 502 by way of a pin 711.

The other end of the bell crank 712 is operatively connected with a solenoid 716 which is fixed to the main frame 502 by way of an actuating rod 716A and a connection plate 718. The upper end of the hook plate 706 is resiliently connected with the main frame 520 by way of a spring 720 and therefore subject to a bias which tends to rotate the plate 706 in the counter clockwise direction.

When the solenoid 716 is de-energized , the hook plate 706 at the shoulder portion 706A formed thereon engages the rod 706 and therefore holds the lower tray 20 at a predetermined angle.

When a predetermined number of sheets have been deposited on the lower tray 20, the solenoid 716 is energized and induces the bell crank 712 to rotate the hook plate 706 against the bias of the spring 720 and moves the same out of engagement with the rod 702.

As a result of this, in accordance with the mass of the sheets which have been collected on the tray, the tray pivots and increases the receiving angle.

When the maximum number of sheets have been collected the cut out 20C engages the shaft 704 and prevents the lower tray from pivoting past its horizontal position.

OPERATION

A. Non sheet folding

Depending on the type of copy machine being used a sheet a machine of folding mode are provided. A non-illustrated control circuit which includes a nicrocomputer, is arranged to issue commands via which the operation of the solenoids 124, 126 and 214 are induced to perform predetermined operations.

The first and secon flappers 122 and 128 are induced to switch in the manner to assume the positions indicated by solid line in FIG. 2 and at the same time, sheet discharge angle control mechanism 200 is arranged so that its initial discharged angle Q1 is about 10 degrees.

At this time, solenoids 142A and 144A are de-energized and thus conditioned to assume their OFF states with the result that the A3Z and B4Z stoppers are both withdrawn from the laterally extending guide or the slanted guide chute 110.

Accordingly, the sheet which is ejected from the copy machine is nipped by the induction roller pair 112, transferred through the laterally extending guide 110, passed through the press rollers 132 and discharged by the discharge roller pair 203 at an angle Q1 onto the upper tray 18.

B. Half folding

During the half sheet folding mode, commands from the non-illustrated control circuit induce a predetermined operation of solenoids 124, 126 and 214. In addition to this first flapper 122 and the second flapper 128 are induced to assume the position shown in broken line and solid line, respectively, in FIG. 2 and the sheet discharge angle control mechanism 200 set to discharge sheets at an angle of approximately 30 degrees. Further, the operation of the sheet size control solenoid 136A is induced. For example, in the case of A3 size sheets the solenoid 136A is set OFF, while in the case of a B4 size sheet, the solenoid 136A is set ON and the B4H stopper 136 induced to project into the temporary storage or accommodation guide chute 106.

The sheet which are introduced through the inlet opening 22 are nipped by the induction rollers 112 while the first flapper 122 is set to the position shown in broken line in FIG. 2 and thus assume a position wherein the imcoming sheet is guided into the downwardly oriented guide chute 104. The transfer rollers 116 then transfers the sheet which is inducted by the induction rollers 112, into the temporary storage guide chute 106.

The sheet which is transferred to the guide chute 106 is such that as the trailing edge thereof separates from the induction rollers 112 it is subjected to be transferred by the first transfer rollers 116 only.

The A3H and B4H stoppers 134 and 136 are arranged in the temporary accommodation guide chute 106 so that when the A3 and B4 sheets are received in the guide 106, they assume positions wherein nip zone of the first press rollers 130 is located mid way along their length.

The solenoid 114 is activated a predetermined time or t1 seconds before the sheet reaches stopper 134 or 136 so that the nip of the first pair of transfer rollers 116 is released and the sheet is allowed to fall under the influence of its own weight until it engages the appropriate stopper. The t1 seconds are calculated as a time difference between an expected arrival time based or the transfer speed of the first transfer roller pair 116 and the size of the sheet and a passed time after the sensor 148 detects the passage of the leading edge of the sheet. Under these conditions, as the sheet is not subject to any force, it seat directly on the stopper and becomes exactly vertical with respect to the same. This allows for any skewing of the sheet that might have occurred due to the operation of the copy machine for example, prior folding.

The solenoid 114 is energized and the first pair of transfer rollers 116 again nip the sheet and tend to move the same. As the leading edge of the sheet is moved against the stopper, the middle of the retained sheet is caused to bow at the junction of the guide chutes 104 and 106, toward the first press rollers 130 and become nipped by the same. As the line of contact defined between the press rollers 130 is parallel to the stopper surface, the folded edge of the sheet is also parallel to the same.

The sheet which is folded by the first pair of press rollers 130 is transferred into the upwardly oriented guide chute 108 and passed through the second set of transfer rollers 118 and 120. Driven rollers of these transfer rollers 118 and 120 are, in order to prevent the formation of undesired wrinkles caused by skew of the sheet, preferably independently suspended against driving rollers.

The sheet is then guided under the influence of the second flapper 128 to pass into the second set of press rollers 132.

The thus half folded sheet after being firstly pressed by the first set of press rollers 130 is subject to further high pressure pressing by the second set of press rollers 132 and then guided by the guide element 146 and discharged by the discharge rollers 203 onto the upper tray 18.

C. Z Folding

During the Z folding mode the control circuit (not shown) induces a predetermined energization of solenoids 124, 126 and 214; the first and second flappers 122 and 128 are conditioned to assume the positions indicated in broken line in FIG. 2; and the sheet discharge angle control mechanism is set to discharge the sheets at an discharge angle Q2 of about 30 degrees.

The sheet size adjusting solenoids 138A and 140A along with solenoids 142A and 144A are selectively activated. In the case of A3 size sheet solenoids 138A and 142A are turned on, while B4 size sheet solenoids 140A and 144A are turned on. Accordingly, the corresponding stoppers are induced to project into the respective guide chutes 106, 110.

In the case of A3 size sheet Z folding, the sheet which is introduced through the inlet opening 22 is nipped by the induction rollers 112 and transferred into the downwardly oriented guide chute 104 in the same manner as in the case of the half folding mode. At this time the A3Z stopper 138 is arranged to project into the temporary accommodation guide chute 106.

The A3Z and B4Z stoppers 138 and 140 are each arranged at a distance from the first set of press rollers 130 so that the sheets become positioned so that they become nipped and subsequently folded to form a crease at the ¼ length positions.

Subsequent operations such as skew correction and folding of the sheet are the same as those used in the half folding mode.

The sheets which are ¼ folded have their leading edges transferred into the upwardly extending guide chute 108. Each of the sheets then is directed by the second flapper 128 into the laterally extending transfer guide chute 110 wherein ¼ folded edge engages the A3Z stopper 142 which projects thereinto.

The A3Z and B4Z stoppers 142 and 144 are each arranged at a distance from the nip position of the second set of press rollers 132 by a ¼ length of the sheet.

As the projection of the stopper 142 restricts further transfer, the continued operation of the upper pair of transfer rollers 120 in the upwardly oriented guide chute 108 causes the sheet to bow and become nipped by the second set of press rollers 132 at a ¼ length position from the ¼ folded edge, that is, at the middle position of the sheet. This second folding is such as to complete the Z folding process.

The thus Z folded sheet is then discharged in the same manner as in the case of the half folding mode but at an discharge angle of 30 degrees.

As shown in FIG. 3 the stack of Z folded sheets S which are collected on the upper tray 18 is much higher at the one due to the multiple folds. However, by increasing the discharge angle the problem wherein the leading ends of the discharged sheets tend to engage in an undesirable manner with previously discharged sheet which is on top of the stack collected on the upper tray, is obviated.

D. Sorting

Sorting on the upper tray 18 is performed using a shift mechanism 300 which enables the order of the sheets to be recognized.

When the sorting mode is selected the sensor 150 which is associated with the guide member 146 senses the passage of the sheet and induces appropriate management. If the next sheet is not detected for t2 seconds after the previous sheet has passed by the sensor 150 the electric motor 304 is energized to induce the cam wheel 308 to rotate through 180 degrees. This causes the connection plate 310 to induce the upper tray to be shifted by a predetermined amount. Following this, the discharge rollers 203 discharge the next sheet in a manner which causes the same to fall at a location which is displaced to one side with respect to the location at which the former sheet was deposited. This enables the instant sheet to be distinguished from the former one.

It should be noted that this sorting function can be executed irrespective of the selection of the non folding mode, the half folding mode and the Z folding mode.

E. Fastening

When the fastening mode is selected, the sensor 150 is used to detect the passage of a sheet through the guide 146. Between t3 and t4 seconds after the passage of the sheet or until the next sheet is detected the sheet aligning mechanism 500 induces aligning of the sheets which have been accumulated on the upper tray.

The sheet aligning mechanism 500 is, as previously mentioned, under normal conditions located below the guide element 146. When the sensor 150 detects the passage of a sheet, the motor 506 is energized and the friction roller 540 is induced to swing out through the opening 18H formed in the gate plate 18D and extend over the upper surface of the upper tray 18. Accordingly, under the influence of the friction roller 540 the sheet which has been discharged, is pushed across the top of the upper tray (see FIG. 11) so that one corner projects out into the cut out portion 18G the rear edge of the sheet engages the gate plate 18D and one of the side edges engages the upright side wall 18F.

With this friction roller arrangement irrespective of the size of the sheet which is discharged, it will be moved to that the rear left corner is aligned with the rear left corners of the sheets previously discharged during the sorting mode. With the sheets thus positioned the tray can be shifted by the tray shift mechanism, stapler 414 swung into position (see FIG. 6), and the stack of sheets fastened together after confirming their right positions by means of a senior (not shown). Following this, the stapler and the tray swung back to their respective home positions.

A staple fastens the sheets diagonally with respect to the rear and side edges of the sheets so that this method of fastening enables the sheets which are fastened together to be readily turned or thumbed over.

R. Tray Rise

Figure 15:
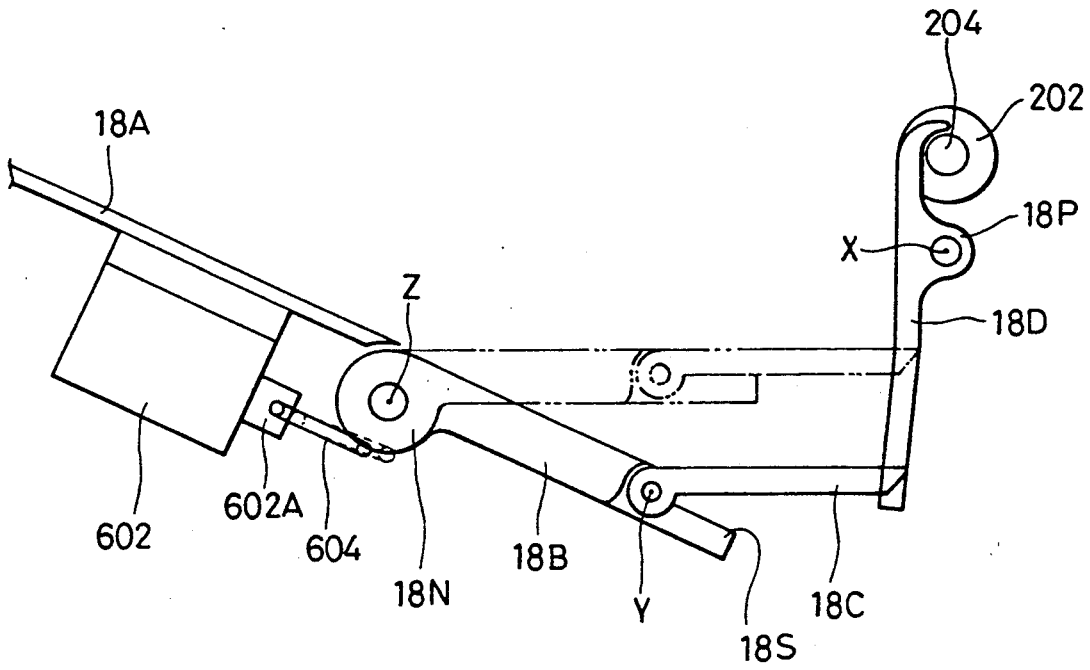
FIG. 15 is a sectional view showing the rise movement of the upper tray.

This operation is performed in accordance with finisher mode which is selected. That is to say, when sheet folding is not being performed, the door section 18C and the flap section 18B are, as shown in FIG. 15, capable of being raised to a first position wherein sheet alignment is facilitated and when sheet folding is being performed these section 18C and 18B are lowered to a second position wherein the capacity of the tray is increased. When the finisher is operating in a non folding mode, the solenoid 602 is de-energized (OFF) and the flap section 18B is subject to the tractive force of the spring 666, it rotates about the axis Z of the guide bar 19A. At the same time the door section 18C assumes the above mentioned first position as shown in phantom in FIG. 15.

Under these conditions the distance between the discharge roller 202 and the upper surface of the upper tray 18 is reduced and the sheets which are discharged are subject to a reduced flotation effect produced by the air between the sheet and the tray and thus collect with essentially no deviation.

It should be noted that the gate plate 18D is formed with a plurality of apertures 18Q which act as air vents and which added to the floating attenuation.

When the finisher is operating in a folding mode or a fastening mode, the flap section 18B and the door section 18C are moved to the second position shown in solid line in FIG. 15.

When the above mentioned modes are selected the solenoid 612 is firstly energized. Under these conditions the initial portion of the stroke of the actuator rod 612A is such as to release the gate plate 18D lock, while the final portion of said stroke is such as to induce the gate plate 18D to rotate about the axis X.

In other words, the initial stroke of the actuator rod 612A is such as to induce bell crank 624 to rotate via its connection with the connection plate 618. At this time the arm 614 is not induced to move due to lost motion effect provided by the slot 618A in the connection plate 618. The rotation of the bell crank 624 is subsequently transmitted to the lock release arm 628, the lock release arm 628 cooperates with the finger like catch member 638 of the lock device 630A in a manner which induces the actuator rod 636 to be withdrawn and the locking of the gate plate 18D released.

As the stroke of the actuator rod 612A proceeds, the gate plate 18D is opened under the influence of the rotation of arm 620.

Under these conditions, solenoid 602 is energized, connection plate 604 induces the arm 606 to rotate the boss 18N to which it is fixed to rotate the flap section 18B. The flap section 18B then rotates about the axis Z against the bias of spring 666, and at the same time the connected door section 18C swings downwardly about the axis Y.

Under the influence of spring 668 the door section 18C tends to be pivoted about the Y axis, however, this rotation is prevented due to the engagement with the extensions 18R of the side walls 18F, and its position is maintained.

Following this, solenoid 612 is de-energized and the gate plate 18D is returned to its original position umber the influence of spring 616. At the same time, the first lock mechanism is returned to its original state and the gate plate 18D is again locked in place.

G. Escape

Following the above described fastening operation, the escape operation takes place. Viz., the gate plate 18D, the flap section 18B and the door section 18C are opened simultaneously and the fastened stack of sheets is premitted to drop onto the lower tray 20.

A predetermined time after the fastening operation is detected as having occurred, the solenoids 612 and 648 are energized. As a result, the above mentioned first lock mechanism 630A is released and the gate plate 18D is permitted to open. At the same time, the actuator rod 648A of the solenoid 648, during the initial portion of its stroke, induces the release of the second lock mechanism 630B. During the final stage of its stroke the flap section 18B is opened.

That is to say, during the initial portion of the actuator rod 648A stroke, the bell crank 650 is rotated pulling the arm 658. At this time, as the pin 656 which extends from the arm 654, is received in the slot 658A of the arm 658, a lost motion connection is established which temporarily prevents the arm 654 from being induced to rotate.

However, when the stroke of the actuator rod 648A enters into the latter portion of its stroke, the arm 654 is induced to rotate about the fifth pin 646 and the ninth pin 664 which is received in slot 654A, induces the door section 18C to rotate about the Y axis.

As the door section 18C rotates, the flap section 18B rotates about the Z axis and thus rotates simultaneously with the door section 18C. This movement is absorbed by the slot 604A formed in the connection plate 604 which is connected to the actuator rod 602A of the solenoid 602.

After the fastened stack of sheets is dropped onto the lower tray 20 solenoids 612 and 648 are de-energized and the gate plate 18D, the door section 18C and the flap section 18B are returned to their respective second positions in the manner illustrated in FIG. 15. At this time the de-energization of solenoid 648 is induced to occur after the de-energization of solenoid 612.

H. Lower tray angle switching

Figure 17:
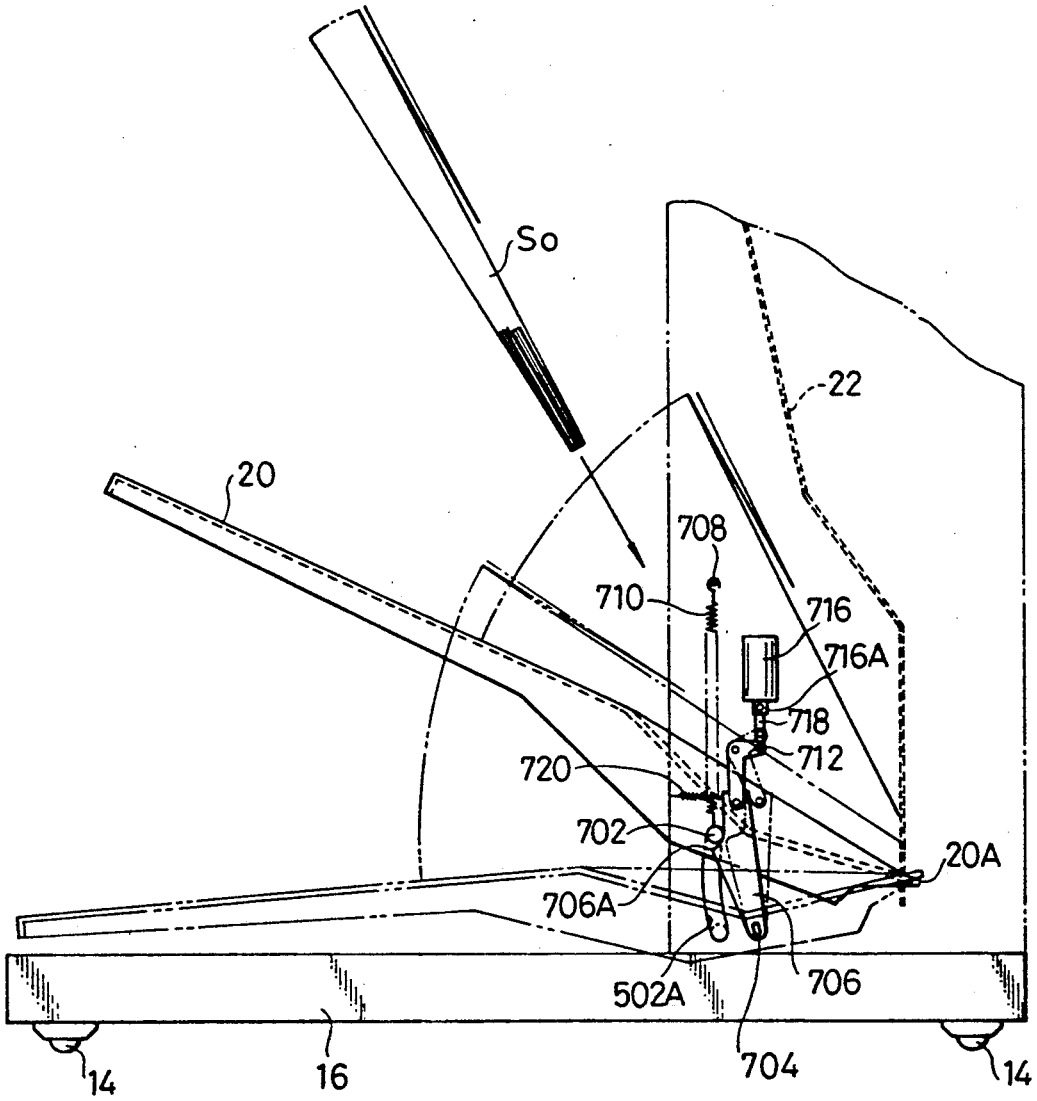
FIG. 17 is a side elevation showing the above mentioned movement.

The fastened stack of sheets is dropped carefully at a predetermined angle from the upper tray 18 onto the lower one in a manner to form a neat pile. Particularly, in the case of Z folding, as one end of the other, an effective receiving angle for the stack of sheets so tends to be reduced as shown in FIG. 17.

In order to maintain a sufficiently wide receiving angle, the instant embodiment is arranged so that when the presence of 120 sheets is detected, solenoid 716 is momentarily energized.

As a result of this energization, the connection between the previously disclosed hook plate 706 and the rod 702 is released and the lower tray 20 is permitted to pivot under its own weight and the weight of the sheets which have accumulated thereon, to a position which increases the receiving angle into which the stack which is being dropped next, can enter.

It should be noted however, that when the stacks which have accumulated on the lower tray 20 are removed the spring 710 induces the tray to swing back to its original positon wherein it is automatically locked, so as to prevent the lower tray 20 from bounding in response to the dropping of the stack of sheets 50.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A sheet finisher comprising:

a tray;

sheet folding means for producing a plurality of sheet folding modes including a non-folding mode;

sheet discharge means for discharging a sheet onto said tray; and position control means for changing the level of a portion of said tray such that the distance between said sheet discharge means and said portion of said tray varies in accordance with the folding mode being produced by said sheet folding means;

wherein said position control means moves said portion of said tray such that the distance between said tray and said sheet discharge means is reduced during said non-folding mode;

and wherein said position control means comprises:

a tray main body arranged to be slanted at a predetermined angle;

a flap section pivotally connected to said main tray body;

a door section pivotally connected to said flap section;

a main wall, said main wall being pivotally mounted on said tray main body by a bracket;

first moving means for moving said flap section and said door section to a first position in which said flat section and said door section are in a substantially horizontally aligned state; and second moving means for moving said flap section and said door section to a second position in which said slanted tray main body and said flap section are maintained at the same angle and said door section is maintained substantially horizontally.

2. A sheet finisher as claimed in claim 1, wherein said first moving means comprises:

a first side wall, said first side wall being provided on said tray main body and having an edge;

a second side wall, said second side wall being formed on said flap section and having an edge which is engageable with the edge on said first side wall;

first biasing means, extended between said bracket and said flap section, for biasing said flap section such that the edge of said first side wall is induced to move toward engagement with the edge of said seocnd side wall formed on said flat section; and a tongue portion formed on the leading edge of said flap section, said tongue portion preventing the relative rotation between said flap section and said door section when they are arranged to define a common flat surface.

3. A sheet finisher as claimed in claim 2 wherein said second moving means comprises:

electromagnetic drive means, disposed on said tray main body, for moving said flap section against the bias of said first biasing means;

an extension portion arranged to extend from the edge of said second side wall and to engage the upper surface of said door section when said door section and said flat section assume a predetermined angle with respect to one another; and second biasing means, extended between said bracket and said door section, for biasing said door section in a direction to engage said extension portion.

4. A sheet finisher as claimed in claim 1, wherein said main wall is formed with a plurality of apertures through which air can be vented.

* * * * *